US007950109B2

(12) United States Patent
Elliott et al.

(10) Patent No.: US 7,950,109 B2
(45) **Date of Patent: *May 31, 2011**

(54) VEHICLE 180 DEGREE REAR DOOR ARTICULATING MECHANISM

(75) Inventors: Adrian N. A. Elliott, Dearborn, MI (US); Justin T. Johnson, Dearborn, MI (US); Jason Falenski, Berkley, MI (US); Craig Blust, Oakland, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 597 days.

This patent is subject to a terminal disclaimer.

(21) Appl. No.: 11/948,436

(22) Filed: Nov. 30, 2007

(65) Prior Publication Data

US 2009/0070960 A1 Mar. 19, 2009

Related U.S. Application Data

(60) Provisional application No. 60/972,549, filed on Sep. 14, 2007.

(51) Int. Cl.
*E05D 3/06* (2006.01)

(52) U.S. Cl. ..... 16/366; 16/334; 16/371; 296/146.11; 296/146.12

(58) Field of Classification Search ..... 16/366, 16/297, 321, 334, 50, 82, DIG. 17, DIG. 21, 16/371, 374, 343, 344; 296/146.11, 146.12
See application file for complete search history.

(56) References Cited

U.S. PATENT DOCUMENTS 3,051,999 A 9/1962 Schimek
3,075,803 A 1/1963 Wilfert
3,313,063 A 4/1967 Patin
3,619,853 A 11/1971 Merrill
3,628,216 A 12/1971 Savell
3,758,990 A 9/1973 Balanos
3,935,674 A 2/1976 Williams et al.

(Continued)

FOREIGN PATENT DOCUMENTS

DE 3831698 A1 3/1990

(Continued)

OTHER PUBLICATIONS

Office Action dated Aug. 27, 2010 in co-pending U.S. Appl. No. 12/022,276.

(Continued)

*Primary Examiner* — William L. Miller
(74) *Attorney, Agent, or Firm* — Gregory P. Brown; Price, Heneveld, Cooper, DeWitt & Litton, LLP

(57) ABSTRACT

A vehicle rear door unsequenced articulating mechanism including one or more articulating hinge assemblies having one or more hinge arms pivotally mounted to a vehicle C-pillar at one end thereof via a C-pillar hinge mount and pivotally mounted to a vehicle rear door at another end thereof via a door hinge mount. The hinge arm may include a generally U-shaped profile between the ends thereof for permitting unsequenced articulation of the rear door up to 180° from a rear door closed position. The door hinge mount may include a door check engageable with a stop on the hinge arm, for limiting pivotal movement of the vehicle rear door to a first intermediate open position from the rear door closed position, upon pivotal movement of the door check relative to the hinge arm.

22 Claims, 22 Drawing Sheets

U.S. PATENT DOCUMENTS

| | | | | |
|---|---|---|---|---|
| 4,025,104 | A | 5/1977 | Grossbach et al. | |
| 4,135,760 | A | 1/1979 | Grossbach | |
| 4,719,665 | A * | 1/1988 | Bell | 16/232 |
| 4,945,677 | A | 8/1990 | Kramer | |
| 5,139,307 | A | 8/1992 | Koops et al. | |
| 5,251,953 | A | 10/1993 | Willey | |
| 5,398,988 | A | 3/1995 | DeRees et al. | |
| 5,474,344 | A | 12/1995 | Lee | |
| 5,507,119 | A | 4/1996 | Sumiya et al. | |
| 5,561,887 | A | 10/1996 | Neag et al. | |
| 5,685,046 | A | 11/1997 | Neag et al. | |
| 5,812,684 | A | 9/1998 | Mark | |
| 5,846,463 | A | 12/1998 | Keeney et al. | |
| 5,896,704 | A | 4/1999 | Neag et al. | |
| 5,921,613 | A | 7/1999 | Breunig et al. | |
| 6,030,025 | A | 2/2000 | Kanerva | |
| 6,036,257 | A | 3/2000 | Manuel | |
| 6,183,039 | B1 | 2/2001 | Kohut et al. | |
| 6,196,618 | B1 | 3/2001 | Pietryga et al. | |
| 6,213,535 | B1 | 4/2001 | Landmesser et al. | |
| 6,286,260 | B1 | 9/2001 | Grabowski | |
| 6,299,235 | B1 | 10/2001 | Davis et al. | |
| 6,305,737 | B1 | 10/2001 | Corder et al. | |
| 6,328,374 | B1 | 12/2001 | Patel | |
| 6,382,705 | B1 | 5/2002 | Lang et al. | |
| 6,394,529 | B2 | 5/2002 | Davis et al. | |
| 6,447,054 | B1 | 9/2002 | Pietryga et al. | |
| 6,572,176 | B2 | 6/2003 | Davis et al. | |
| 6,609,748 | B1 * | 8/2003 | Azzouz et al. | 296/146.1 |
| 6,629,337 | B2 | 10/2003 | Nania | |
| 6,793,268 | B1 | 9/2004 | Faubert et al. | |
| 6,802,154 | B1 | 10/2004 | Holt et al. | |
| 6,817,651 | B2 | 11/2004 | Carvalho et al. | |
| 6,826,869 | B2 | 12/2004 | Oberheide | |
| 6,860,543 | B2 | 3/2005 | George et al. | |
| 6,896,315 | B2 | 5/2005 | Batinli et al. | |
| 6,913,308 | B2 | 7/2005 | Azzouz et al. | |
| 6,926,342 | B2 | 8/2005 | Pommeret et al. | |
| 6,938,303 | B2 | 9/2005 | Watson et al. | |
| 6,942,277 | B2 | 9/2005 | Rangnekar et al. | |
| 6,997,504 | B1 | 2/2006 | Lang et al. | |
| 7,000,977 | B2 | 2/2006 | Anders | |
| 7,003,915 | B2 | 2/2006 | Yokomori | |
| 7,032,953 | B2 | 4/2006 | Rangnekar et al. | |
| 7,104,588 | B2 | 9/2006 | George et al. | |
| 7,168,753 | B1 | 1/2007 | Faubert et al. | |
| 7,178,853 | B2 | 2/2007 | Oxley et al. | |
| 7,219,948 | B2 | 5/2007 | Curtis, Jr. et al. | |
| 7,243,978 | B2 | 7/2007 | Mather et al. | |
| 7,383,614 | B2 | 6/2008 | Matsuki | |
| 7,393,044 | B2 | 7/2008 | Enomoto | |
| 7,438,346 | B1 | 10/2008 | Breed | |
| 7,469,944 | B2 * | 12/2008 | Kitayama et al. | 292/262 |
| 7,552,953 | B2 * | 6/2009 | Schmoll et al. | 292/267 |
| 7,611,190 | B1 | 11/2009 | Elliott et al. | |
| 7,636,985 | B2 * | 12/2009 | Greenbank | 16/389 |
| 7,640,627 | B2 * | 1/2010 | Lowen et al. | 16/86 C |
| RE41,143 | E | 2/2010 | Rangnekar et al. | |
| 7,658,438 | B1 | 2/2010 | Elliott et al. | |
| 7,765,740 | B2 | 8/2010 | Heuel et al. | |
| 2002/0096800 | A1 | 7/2002 | Keeney et al. | |
| 2003/0218358 | A1 | 11/2003 | Hahn | |
| 2005/0093337 | A1 | 5/2005 | Herrmann et al. | |
| 2005/0116496 | A1 | 6/2005 | Lowson et al. | |
| 2005/0146159 | A1 | 7/2005 | Shen et al. | |
| 2006/0059799 | A1 | 3/2006 | Zimmer et al. | |
| 2006/0103047 | A1 | 5/2006 | Zwolinski | |
| 2006/0249983 | A1 | 11/2006 | Heuel et al. | |
| 2006/0267375 | A1 | 11/2006 | Enomoto | |
| 2007/0075565 | A1 | 4/2007 | Magsaam | |
| 2007/0085374 | A1 | 4/2007 | Mather et al. | |
| 2007/0214606 | A1 | 9/2007 | Hoffman | |
| 2008/0190028 | A1 | 8/2008 | Oxley | |
| 2008/0224501 | A1 | 9/2008 | Zimmer et al. | |
| 2009/0000200 | A1 | 1/2009 | Heuel et al. | |
| 2009/0051194 | A1 | 2/2009 | Elliott et al. | |
| 2009/0072582 | A1 | 3/2009 | Elliott et al. | |
| 2009/0072583 | A1 | 3/2009 | Elliott et al. | |
| 2009/0200833 | A1 | 8/2009 | Heuel et al. | |
| 2010/0127530 | A1 | 5/2010 | Elliott et al. | |
| 2010/0154313 | A1 | 6/2010 | Elliott et al. | |
| 2010/0171336 | A1 | 7/2010 | Elliott et al. | |

FOREIGN PATENT DOCUMENTS

| | | | |
|---|---|---|---|
| DE | 102004039885 | A1 | 2/2006 |
| EP | 0012511 | A1 | 6/1980 |
| EP | 0875434 | A1 | 11/1998 |
| EP | 0957019 | A2 | 11/1999 |
| EP | 1813759 | A1 | 8/2007 |
| GB | 389061 | | 5/1931 |
| JP | 3140583 | A | 6/1991 |
| JP | 3140584 | A | 6/1991 |
| JP | 2004175199 | A | 6/2004 |
| JP | 2005153738 | A | 6/2005 |
| JP | 2007138630 | A | 6/2007 |
| JP | 2008094323 | A | 4/2008 |
| KR | 100448753 | B1 | 9/2004 |
| WO | 0242589 | A1 | 5/2002 |
| WO | 2006005572 | A1 | 1/2006 |

OTHER PUBLICATIONS

Office Action dated Apr. 30, 2010 in co-pending U.S. Appl. No. 12/022,276.

Interview Summary dated Jun. 23, 2010 in co-pending U.S. Appl. No. 12/022,276.

Amendment filed Jun. 27, 2010 in co-pending U.S. Appl. No. 12/022,276.

* cited by examiner

VEHICLE 180 DEGREE REAR DOOR ARTICULATING MECHANISM

RELATED APPLICATIONS

This application claims benefit of priority of Provisional Application Ser. No. 60/972,549 filed Sep. 14, 2007, hereby incorporated by reference in its entirety.

BACKGROUND OF INVENTION a. Field of Invention

The invention relates generally to vehicle door movement control devices, and, more particularly, to a mechanism for vehicle rear door articulation, for example, in a pickup truck, with the mechanism permitting unsequenced opening or closing articulation of up to 180° of a rear door.

b. Description of Related Art

As is known in the art, automobile designs are governed by a variety of ergonomic and operational factors. For doors and other such components, the design is generally based on ergonomic factors such as exterior appearance, and the location and visibility of hinges, latches and adjacent components, and operational factors such as the ingress/egress opening provided, the maximum clearance required for opening/closing a door, and crash performance.

For pickup trucks, sport-utility vehicles (SUVs) and other such vehicles which are designed to accommodate ingress/egress of several passengers and also provide means for transport of large goods, the ingress/egress opening and maximum clearance required for opening/closing a door can be of particular importance. For example, a typical pickup truck having front and back driver/passenger doors may include a C-pillar mounted rear door which pivots relative to the C-pillar in a similar manner as the A-pillar mounted front door to thus provide a relatively large and unobstructed ingress/egress opening without the intermediate B-pillar. In typical pickup trucks, the rear door pivots approximately 90° , thus limiting the ingress/egress area for occupants or for loading/unloading of objects. The access and loading is made particularly difficult, if not impossible, if a vehicle is parked adjacent to the truck and is sufficiently close to prevent an occupant from boarding or loading to enter the area between the front and rear door (when open), invariably known as parking lot entrapment.

In an effort to address such parking lot entrapment concerns, a host of pivoting rear door designs, such as the design disclosed in U.S. Pat. No. 7,032,953 to Rangnekar, have been proposed.

Specifically, referring to FIGS. 5 and 7-13 of Rangnekar, Rangnekar discloses a vehicle door hinge assembly (40) configured and arranged such that rear door (20) is swingably mounted to door mounting pillar (24) for movement between a closed position to a first open position in which the door pivots approximately 90° relative to the closed position about first vertical pivot axis (A1). After reaching the first open position, door hinge assembly (40) is configured such that rear door (20) then pivots about second vertical pivot axis (A2) to open approximately 170° relative to the closed position.

Thus, whereas the hinge assembly (40) of Rangnekar provides for pivoting of rear door (20) up to 170° , as is readily evident from FIGS. 7-13 of Rangnekar, assembly (40) is relatively complex in design and may thus be readily susceptible to failure due to the number of components. More importantly, as discussed above, assembly (40) first allows for pivoting of door (20) to approximately 90° and thereafter to approximately 170°. The 90° stop is provided by latch mechanism (50) (see FIGS. 11, 12) which operates in a sequenced open/close manner, thus limiting the position from which door (20) can be opened/closed if additional intermediate stops are needed.

It would therefore be of benefit to provide a mechanism for permitting opening and closing of a rear door that is not sequenced to open/close in a set manner, but can be opened/closed through rotation of a door or the hinge in any order, and in continuous increments of either operation. It would also be of benefit to provide a mechanism that includes a minimal number of components, thus simplifying the overall design, operation and reducing the related design and assembly costs for the mechanism.

SUMMARY OF INVENTION

The invention overcomes the drawbacks and deficiencies of prior art articulating door mechanisms by providing a vehicle rear door unsequenced articulating mechanism including one or more articulating hinge assemblies having one or more hinge arms pivotally mounted to a vehicle C-pillar at one end thereof via a C-pillar hinge mount and pivotally mounted to a vehicle rear door at another end thereof via a door hinge mount. The hinge arm may include a generally U-shaped profile between the ends thereof for permitting unsequenced articulation of the rear door up to 180° from a rear door closed position. The door hinge mount may include a door check engageable with a stop on the hinge arm, for limiting pivotal movement of the vehicle rear door to a first intermediate open position from the rear door closed position, upon pivotal movement of the door check relative to the hinge arm.

In an exemplary embodiment, the vehicle rear door articulating mechanism may allow a rear door, with a front door being opened, to be opened to approximately 180° and positioned away from the door opening, generally parallel to the vehicle body (i.e. a truck box quarter panel in the embodiment described herein), for facilitating ease of ingress and egress and allowing maximum access for loading and unloading of transportable items. The invention differs from conventional two-stage hinge assemblies in that it is not sequenced to open/close in a set manner, but can be opened/closed through rotation of the rear door or an articulating hinge assembly in any order, and in continuous increments of either operation. This operation simplifies the design of the rear door, the build of the articulating hinge assembly, reduces the cost of the assembly, and simplifies operation, allowing the rear door to be opened/closed more easily from any position. In an exemplary embodiment, the articulating hinge assembly may include a dual hinge with an integrated tie-bar, connected to the rear end of the rear door and for connection to a C-pillar of a vehicle body. In the exemplary ease of a truck, a hinge mount to the truck body may be to the existing C-pillar without modification of the vehicle structure. The articulating hinge assembly may allow rotation of the first or second stage of the opening articulation to take place in sequence or concurrently to the maximum opening of either to enable the door to achieve a fill open position of up to approximately 180° from the closed to the fully open position of the rear door. Stop straps (i.e. door checks) may be integrated into the articulating hinge assembly (ears on the top and the cross bar). As the rear door is rotated to the closed position, the hinges of the articulating hinge assembly may close in a manner that limits rotation and forces the other to close completely as the door latches shut. Notably, the rear door never contacts the vehicle body in any position other then the door closed position.

For the vehicle rear door unsequenced articulating mechanism described above, the hinge arm or the door hinge mount may include one or more first recesses engageable with a first detent on the other one of the hinge arm or the door hinge mount for maintaining the rear door in the first intermediate open position. Further, the hinge arm or the C-pillar hinge mount may include one or more second recesses engageable with a second detent on the other one of the hinge arm or the C-pillar hinge mount for maintaining the rear door in a rear door filly open position. Yet further, the hinge arm or the C-pillar hinge mount may include one or more third recesses engageable with a third detent on the other one of the hinge arm or the C-pillar hinge mount for maintaining the rear door in the rear door closed position. In the rear door filly open position, the second recess and detent may be engageable to prevent pivotal movement of the hinge arm, and the first recess and detent may be disengageable to allow unsequenced pivotal movement of the rear door to a second intermediate open position, generally parallel to the first intermediate open position. The door hinge mount may include a further recess engageable with the stop for maintaining the rear door in the second intermediate open position. In the rear door fully open position, the first and second recesses and detent may be disengageable to allow unsequenced pivotal movement of the rear door to a third intermediate open position. The mechanism may further include a tie-bar connected to an upper and lower hinge arm for thereby providing rigidity for simultaneous operation of upper and lower hinge assemblies.

The invention also provides a vehicle door unsequenced articulating mechanism including one or more articulating hinge assemblies having one or more hinge arms pivotally mounted to a vehicle body structure at one end thereof via a body structure hinge mount and pivotally mounted to a vehicle door at another end thereof via a door hinge mount. The hinge arm may include a generally curved profile between the ends thereof for permitting unsequenced articulation of the door up to a predetermined angle from a door closed position. The door hinge mount may include a door check engageable with a stop on the hinge arm, for limiting pivotal movement of the vehicle door to a first intermediate open position from the door closed position, upon pivotal movement of the door check relative to the hinge arm.

For the vehicle door unsequenced articulating mechanism described above, the hinge arm or the door hinge mount may include one or more first recesses engageable with a first detent on the other one of the hinge arm or the door hinge mount for maintaining the door in the first intermediate open position. Further, the hinge arm or the body structure hinge mount may include one or more second recesses engageable with a second detent on the other one of the hinge arm or the body structure hinge mount for maintaining the door in a door fully open position. Yet farther, the hinge arm or the body structure hinge mount may include one or more third recesses engageable with a third detent on the other one of the hinge arm or the body structure hinge mount for maintaining the door in the door closed position. In the door fully open position, the second recess and detent may be engageable to prevent pivotal movement of the hinge arm, and the first recess and detent may be disengageable to allow unsequenced pivotal movement of the door to a second intermediate open position, generally parallel to the first intermediate open position. The door hinge mount may include a further recess engageable with the stop for maintaining the door in the second intermediate open position. In the door fully open position, the first and second recesses and detent may be disengageable to allow unsequenced pivotal movement of the door to a third intermediate open position. The mechanism may further include a tie-bar connected to an upper and lower hinge arm for thereby providing rigidity for simultaneous operation of upper and lower hinge assemblies.

The invention yet further provides a vehicle compartment closure unsequenced articulating mechanism including one or more articulating hinge assemblies having one or more hinge arms pivotally mounted to a vehicle body structure at one end thereof via a body structure hinge mount and pivotally mounted to a vehicle compartment closure at another end thereof via a compartment closure hinge mount. The hinge arm may include a generally curved profile between the ends thereof for permitting unsequenced articulation of the compartment closure up to a predetermined angle from a compartment closure closed position. The compartment closure hinge mount may include a compartment closure check engageable with a stop on the hinge arm, for limiting pivotal movement of the vehicle compartment closure to a first intermediate open position from the compartment closure closed position, upon pivotal movement of the compartment closure check relative to the hinge arm.

For the vehicle compartment closure unsequenced articulating mechanism described above, the hinge arm or the compartment closure hinge mount may include one or more first recesses engageable with a first detent on the other one of the hinge arm or the compartment closure hinge mount for maintaining the compartment closure in the first intermediate open position. Further, the hinge arm or the body structure hinge mount may include one or more second recesses engageable with a second detent on the other one of the hinge arm or the body structure hinge mount for maintaining the compartment closure in a compartment closure fully open position. Yet further, the hinge arm or the body structure hinge mount may include one or more third recesses engageable with a third detent on the other one of the hinge arm or the body structure hinge mount for maintaining the compartment closure in the compartment closure closed position. In the compartment closure fully open position, the second recess and detent may be engageable to prevent pivotal movement of the hinge arm, and the first recess and detent may be disengageable to allow unsequenced pivotal movement of the compartment closure to a second intermediate open position, generally parallel to the first intermediate open position. The compartment closure hinge mount may include a further recess engageable with the stop for maintaining the compartment closure in the second intermediate open position. In the compartment closure fully open position, the first and second recesses and detent may be disengageable to allow unsequenced pivotal movement of the compartment closure to a third intermediate open position. The mechanism may further include a tie-bar connected to an upper and lower hinge arm for thereby providing rigidity for simultaneous operation of upper and lower hinge assemblies.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION OF THE PREFERRED EMBODIMENTS

Figure 1:
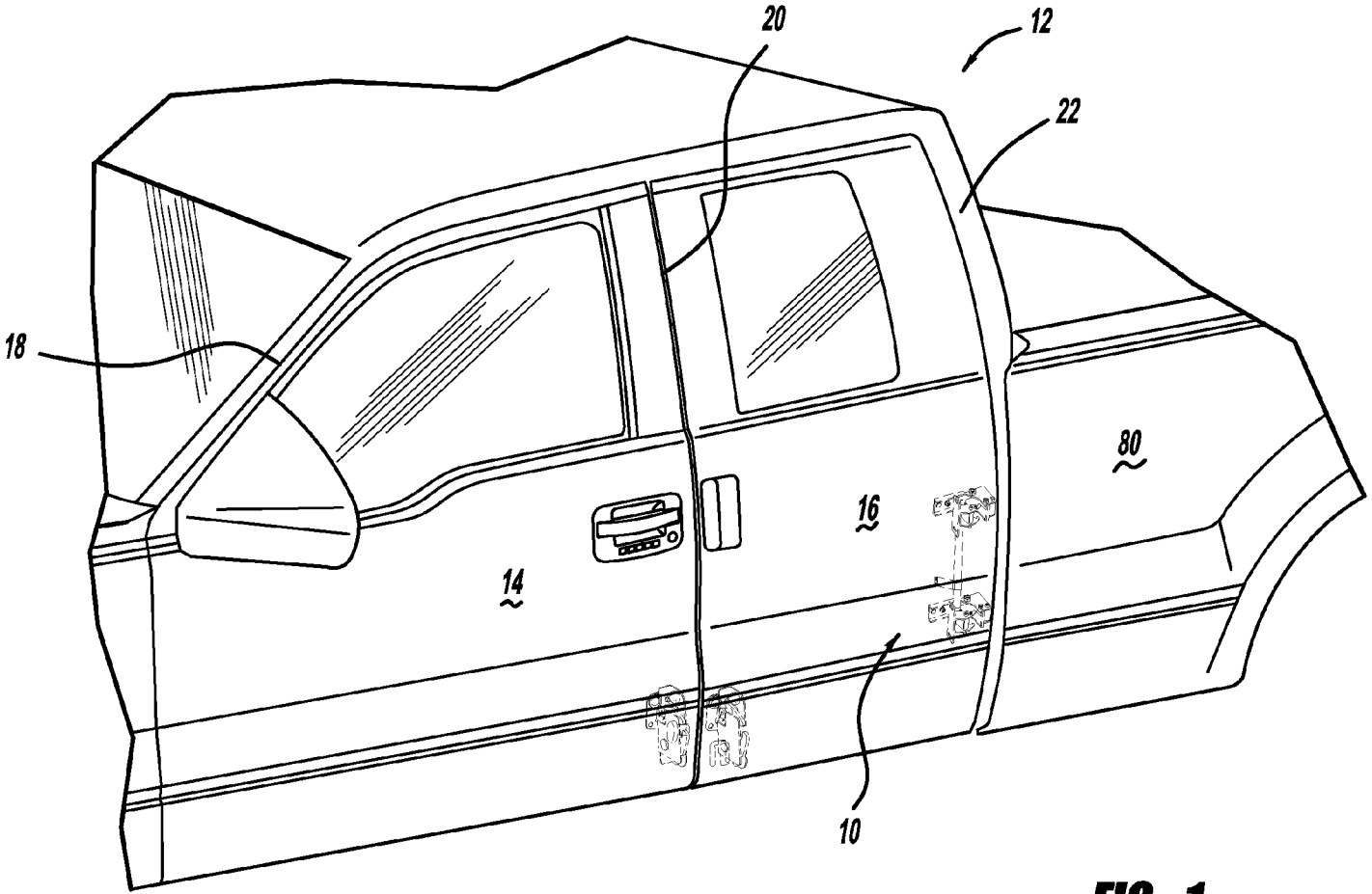
FIG. 1 is an isometric view of a rear door articulating mechanism according to the present invention, illustrating the mechanism in an assembled configuration and installed onto a vehicle (the mechanism being shown in hidden)

Referring now to the drawings wherein like reference numerals designate corresponding parts throughout the several views, FIGS. 1-12B illustrate a mechanism for vehicle rear door articulation according to the present invention, generally designated "rear door articulating mechanism 10."

Figure 2:
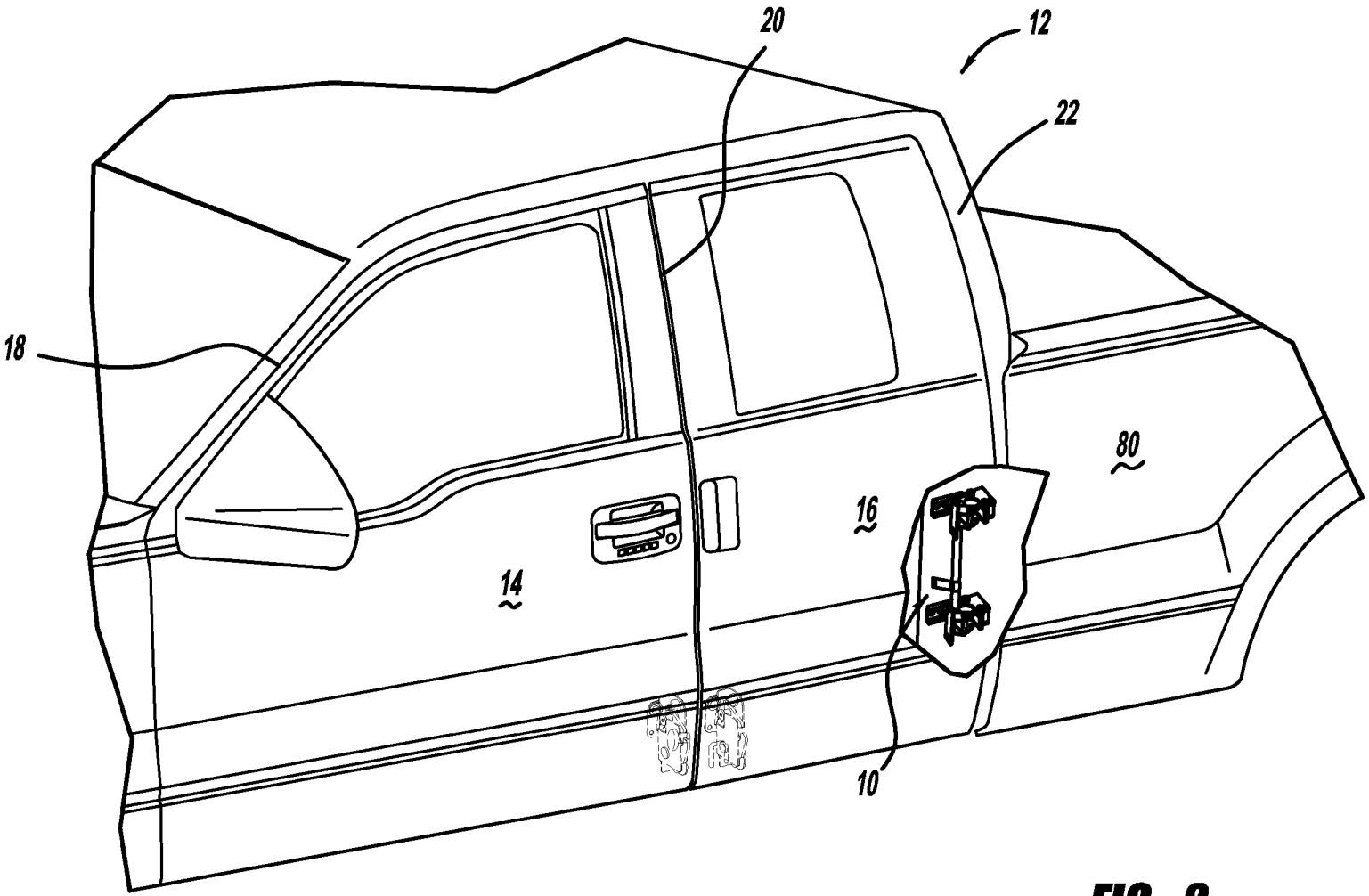
FIG. 2 is an isometric cutout view of the rear door articulating mechanism of FIG. 1, illustrating the mechanism installed onto a vehicle.
Figure 3:
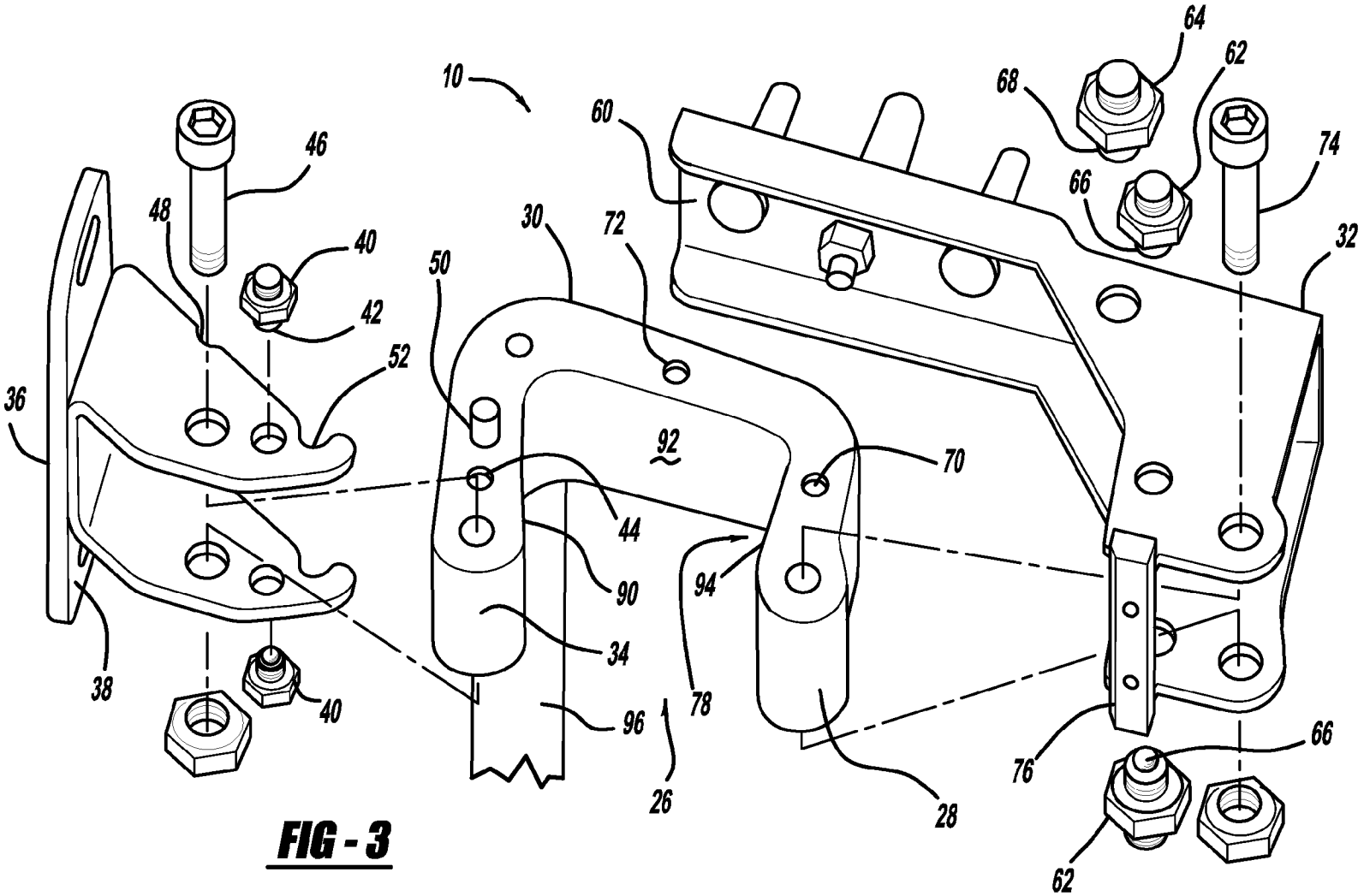
FIG. 3 is an exploded view of the rear door articulating mechanism of FIG. 1, illustrating the various sub-components of the mechanism.
Figure 4:
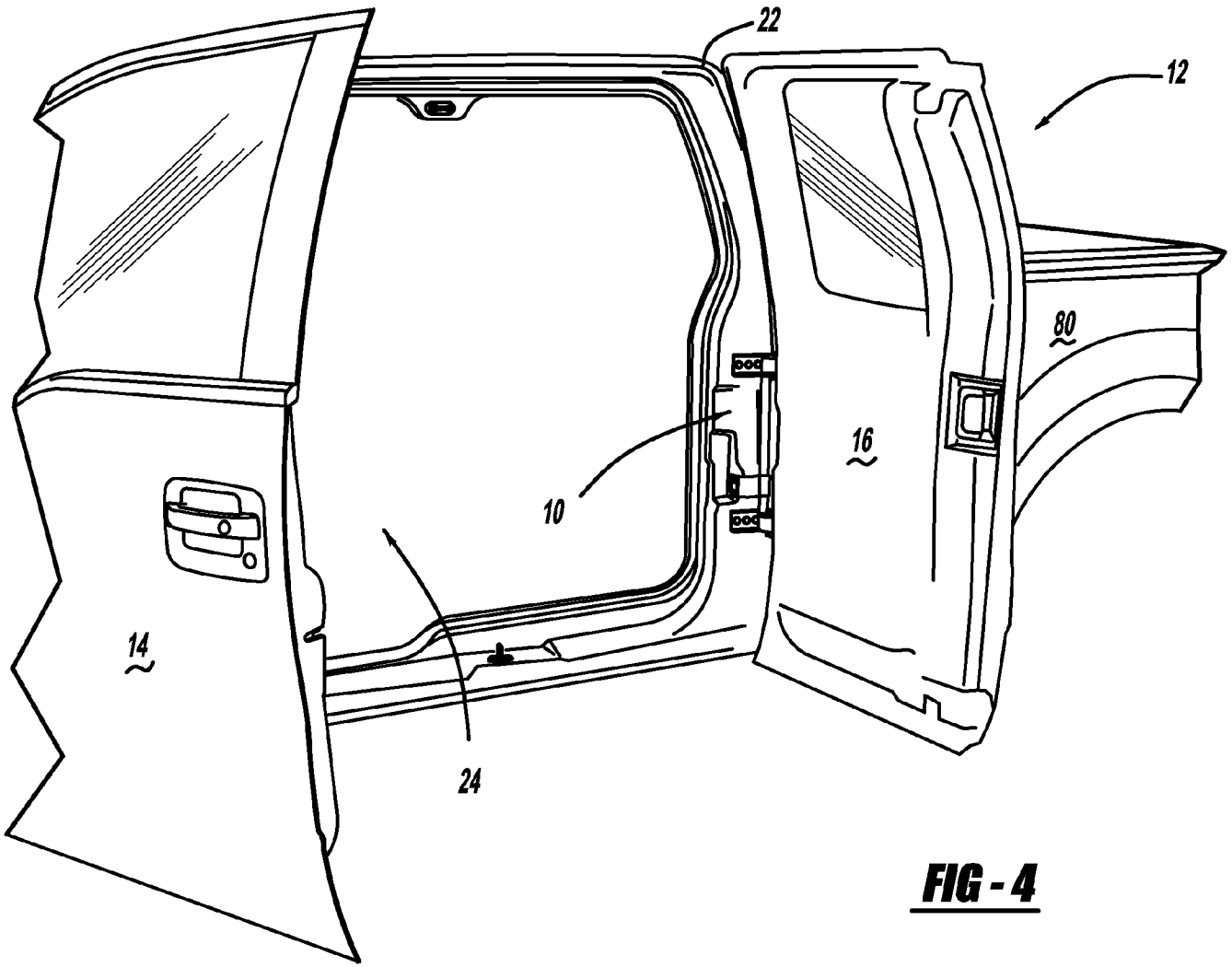
FIG. 4 is an isometric view of the rear door articulating mechanism of FIG. 1, illustrating the mechanism installed onto a vehicle and with a front vehicle door fully open and a rear vehicle door opened approximately 90° relative to the rear door initial closed position.
Figure 5:
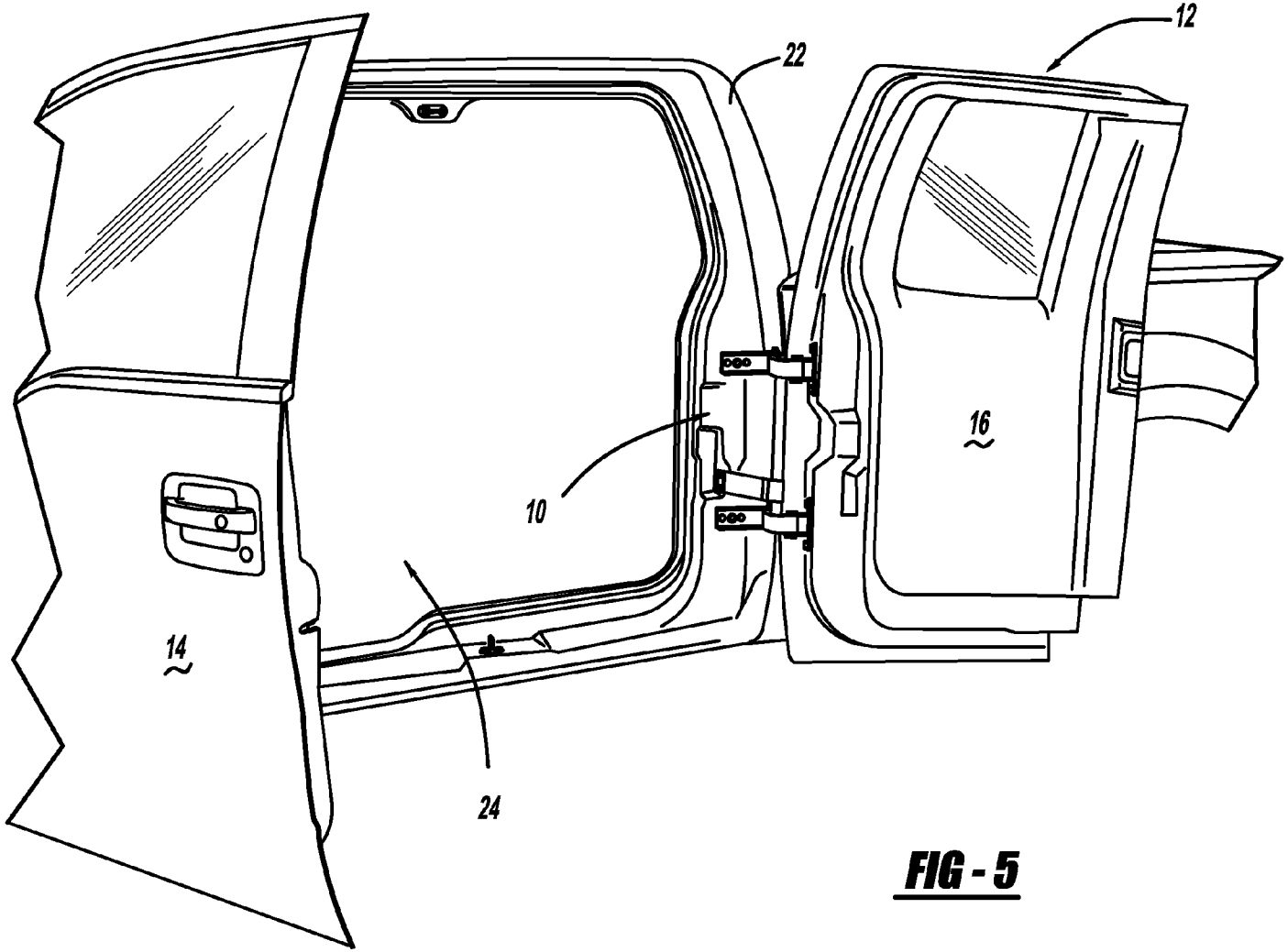
FIG. 5 is an isometric view of the rear door articulating mechanism of FIG. 1, illustrating the mechanism installed onto a vehicle and with the front and rear vehicle doors fully opened (i.e. rear door opened approximately 180° relative to the rear door initial closed position)

Referring to FIGS. 1-3, rear door articulating mechanism 10 may generally be mounted onto a vehicle 12 including front and rear doors 14, 16. In the exemplary embodiment illustrated, vehicle 12 may be a pickup truck including A, B and C pillars 18, 20, 22. As shown in FIGS. 4 and 5, and described in greater detail below, in order to facilitate ingress and egress into and from compartment 24 of vehicle 12, rear door articulating mechanism 10 may allow for complete opening of rear door 16 at up to 180° relative to the rear door initial closed position, and subsequent closing of the rear door without a predetermined closing sequence.

The various sub-components of rear door articulating mechanism 10 will now be described in detail with reference to FIGS. 1-8G.

Specifically, as shown in FIGS. 1-3, rear door articulating mechanism 10 may generally include an articulating hinge assembly 26 pivotally mounted at end 28 of a generally U-shaped hinge arm 30 to C-pillar 22 via C-pillar hinge mount 32 and further pivotally mounted at end 34 of hinge arm 30 to rear door 16 via door hinge mount 36. Those skilled in the art would readily appreciate in view of this disclosure that mechanism 10 may be installed onto a vehicle D-pillar (not shown), or another body structure for facilitating articulated opening/closing of a door or another cover.

Figure 6A:
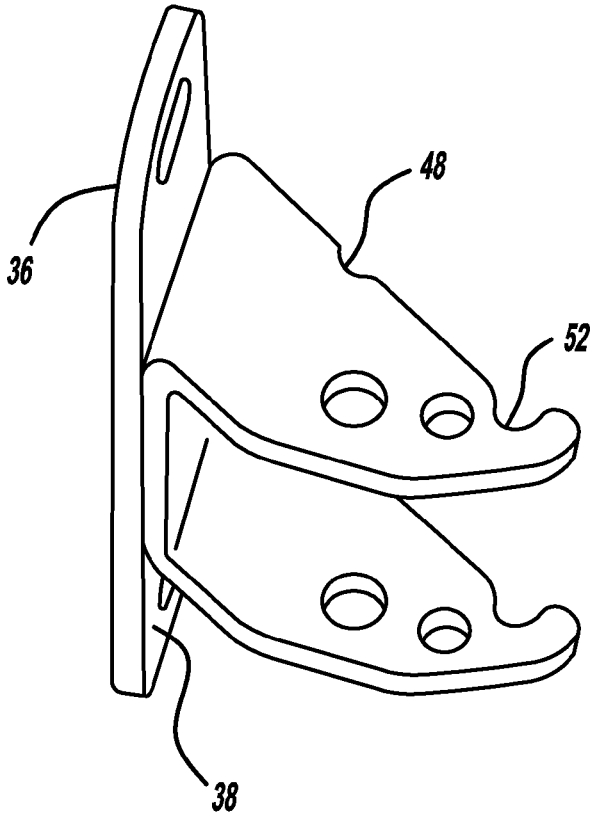
FIG. 6A is an enlarged isometric view of a door hinge mount for attachment of the rear door articulating mechanism of FIG. 1 to a vehicle rear door.
Figure 6B:
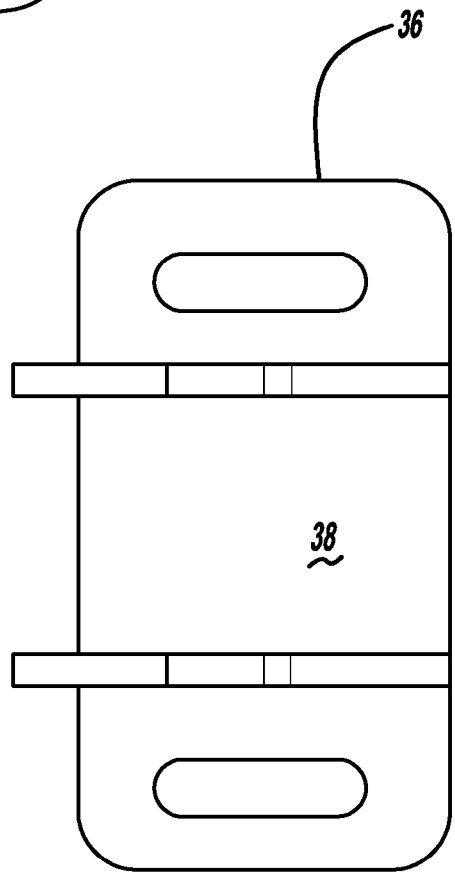
FIGS. 6B-6F are respectively enlarged front, top, bottom, right and left side views of the door hinge mount of FIG. 6A.
Figure 6C:
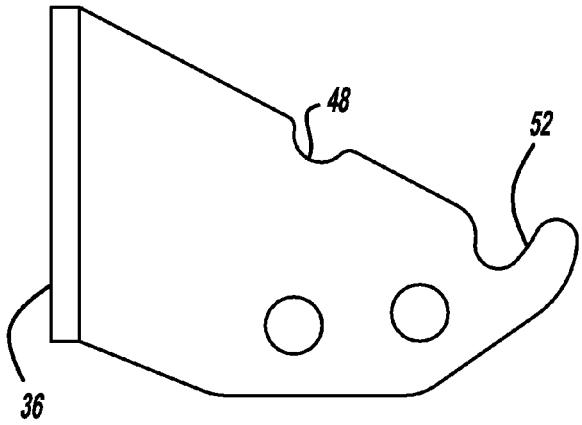
Figure 6D:
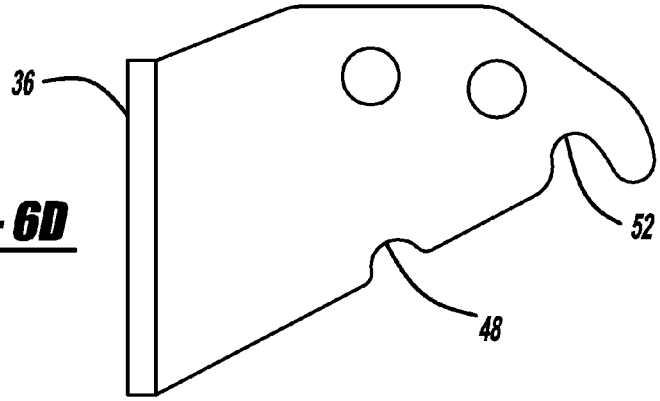
Figure 6E:
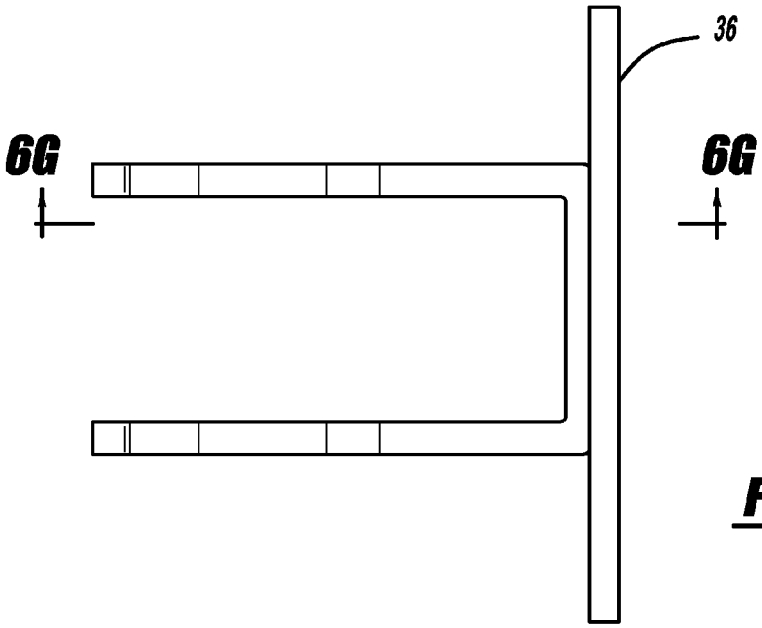
Figure 6F:
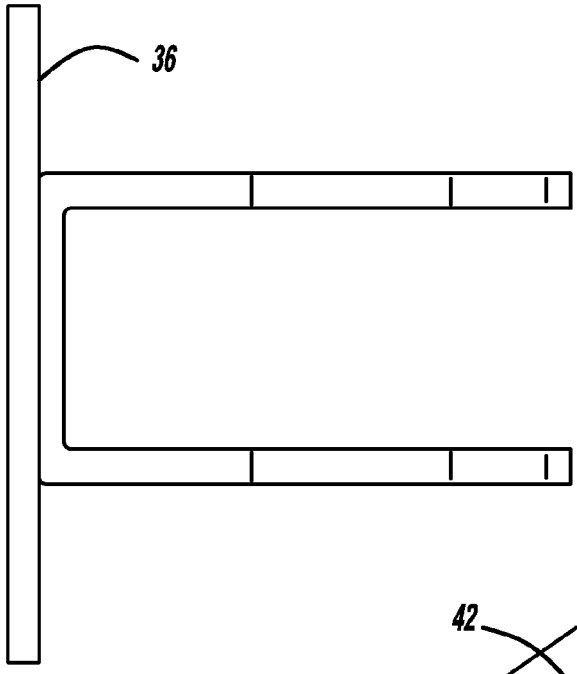
Figure 6G:
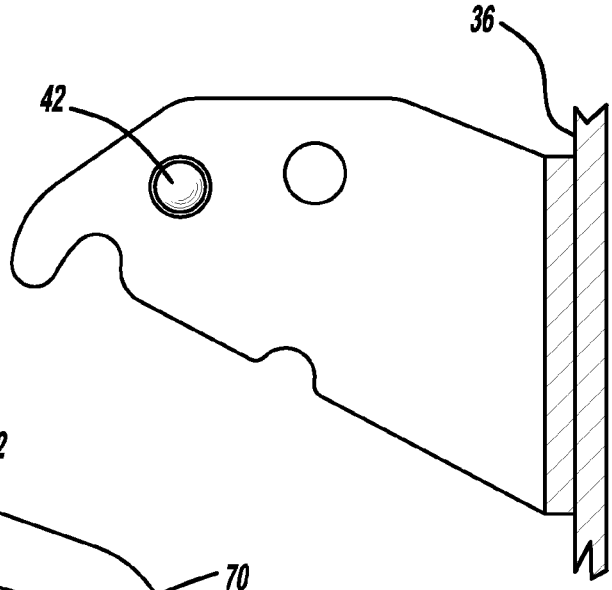
FIG. 6G is an enlarged cross-sectional view of the door hinge mount of FIG. 6A, taken generally along line 6G-6G in FIG. 6E, illustrating a first detent location for controlling predetermined opening/closing of a rear door.
Figure 7A:
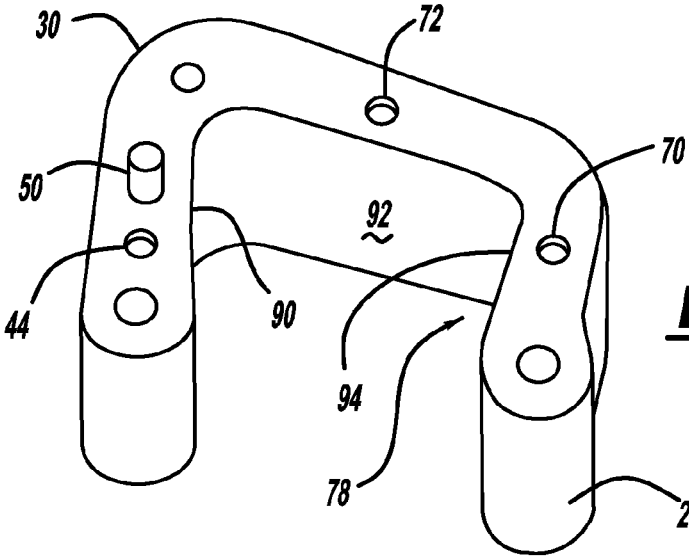
FIG. 7A is an enlarged isometric view of a hinge arm for controlling pivotal movement of a rear vehicle door.
Figure 7B:
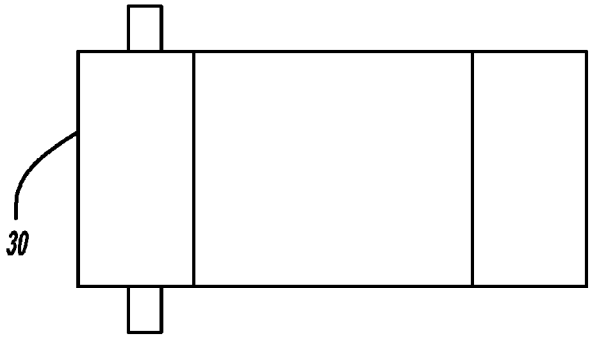
FIGS. 7B-7F are respectively enlarged front, top, bottom, right and left side views of the hinge arm of FIG. 7A.
Figure 7C:
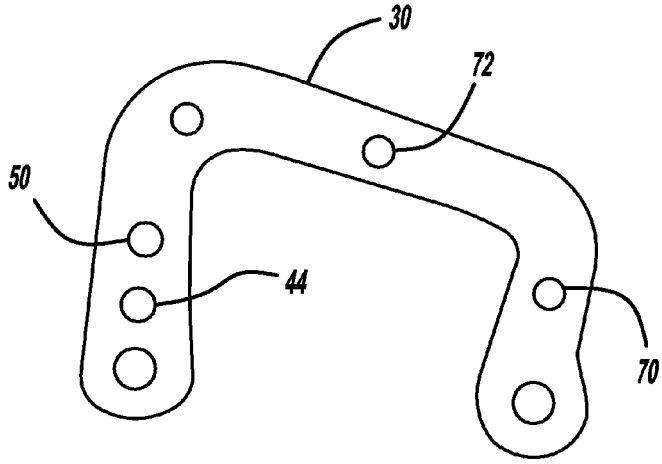
Figure 7D:
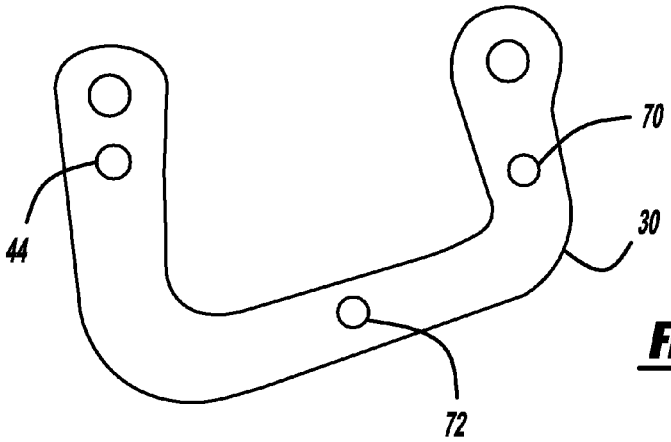
Figure 7E:
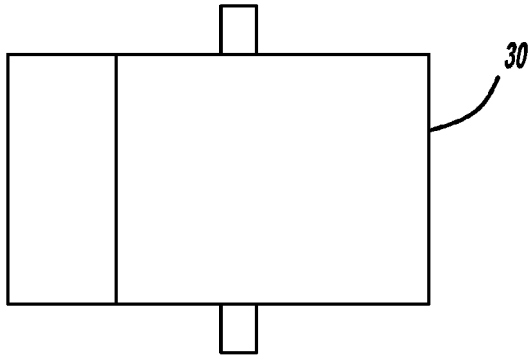
Figure 7F:
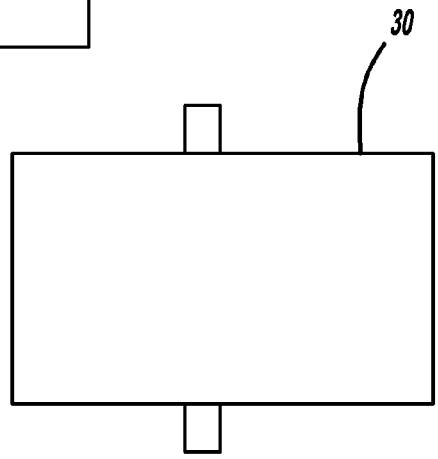

As shown in FIGS. 1-3 and 6A, door hinge mount 36 may include a door mount bracket 38 for attachment of door hinge mount 36 to rear door 16 by means of screws, bolts, or by other means such as welding and the like. As shown in FIGS. 3 and 6G, door hinge mount 36 may further include a spring loaded ball detent 40, hereinafter denoted first detent 40, for controlling predetermined opening/closing of rear door 16, by engagement of ball member 42 in concave recess 44 provided on hinge arm 30. Door hinge mount 36 may also include pivot pin 46 for pivotal connection at end 34 of hinge arm 30.

Figure 9A:
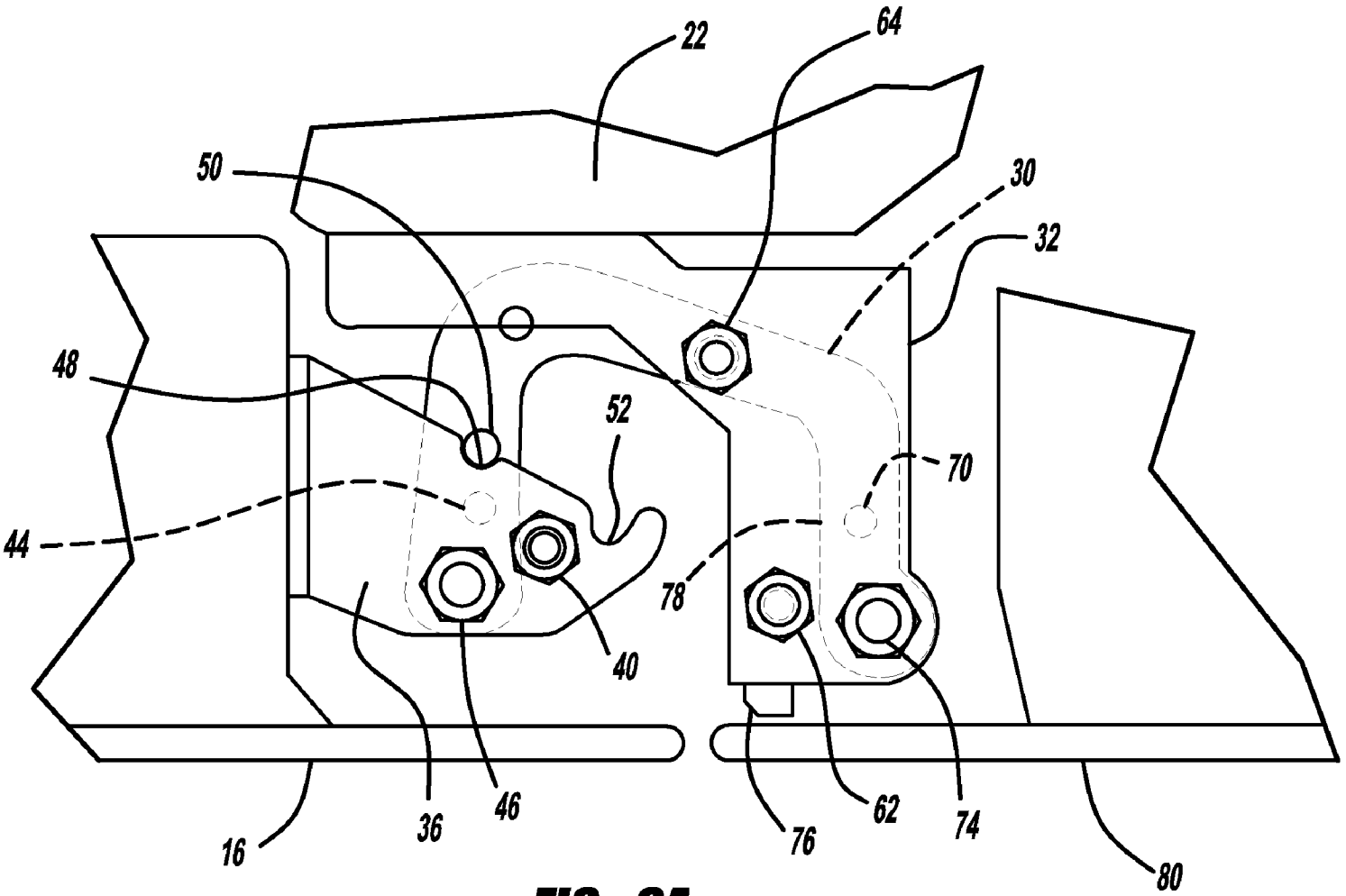
FIGS. 9A-9C are top views of a vehicle including the rear door articulating mechanism of FIG. 1, respectively illustrating the rear vehicle door in closed, and midway (approximately 90°) and fully (approximately 180°) opened positions, with the noted positions governed by the detent locations on the door hinge mount of FIG. 6A and the C-pillar hinge mount of FIG. 8A, and related door checks.
Figure 9B:
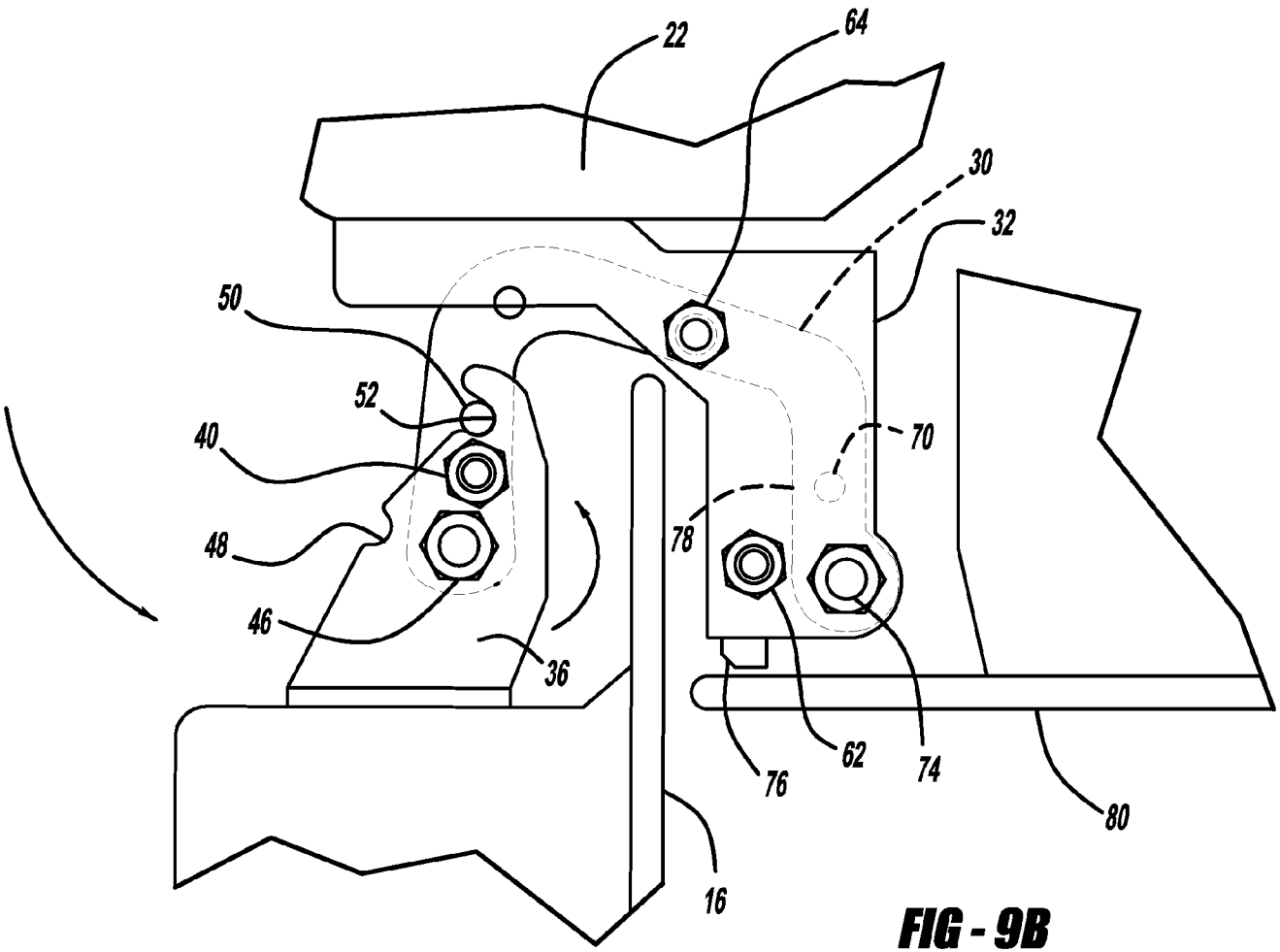
Figure 9C:
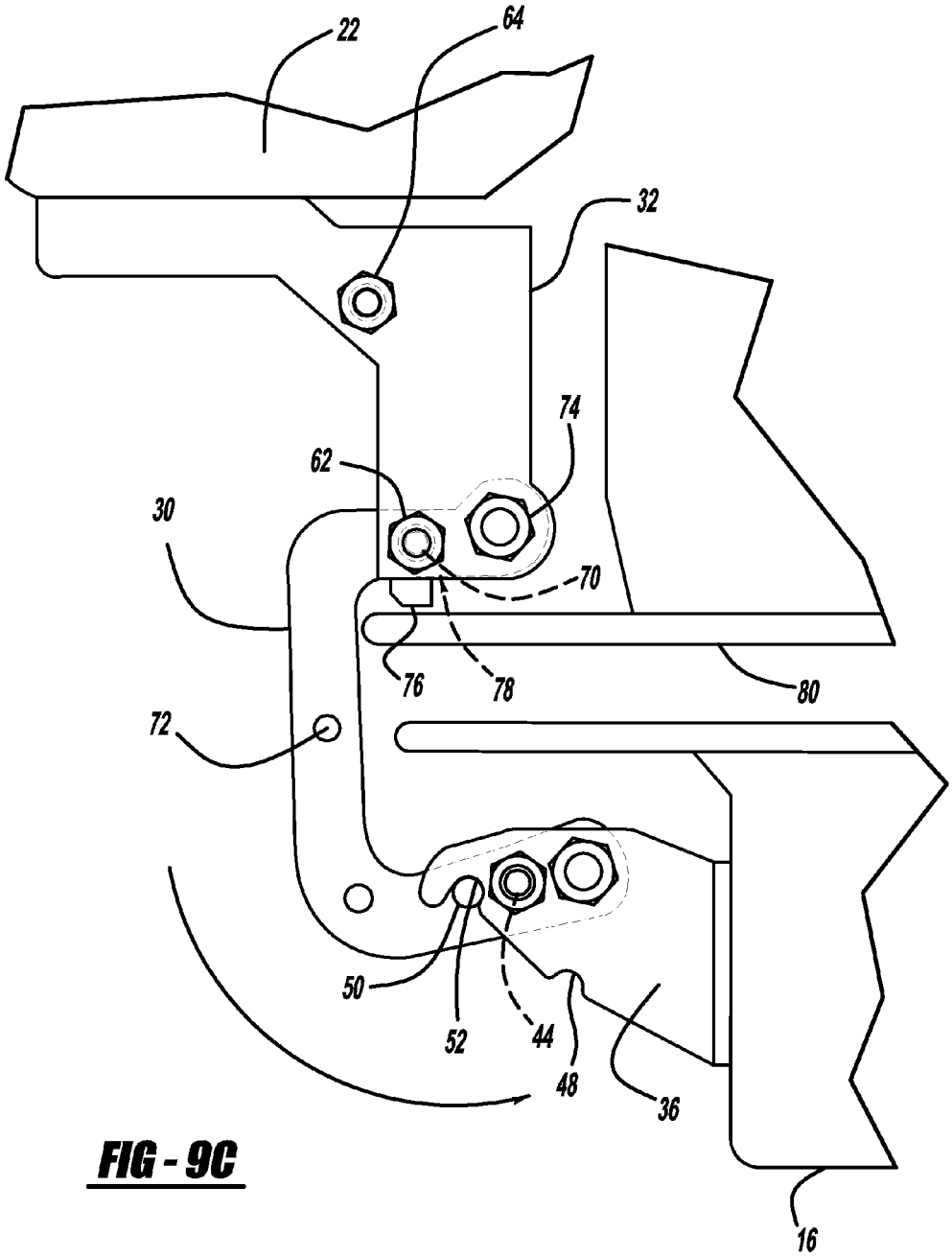
Figure 10A:
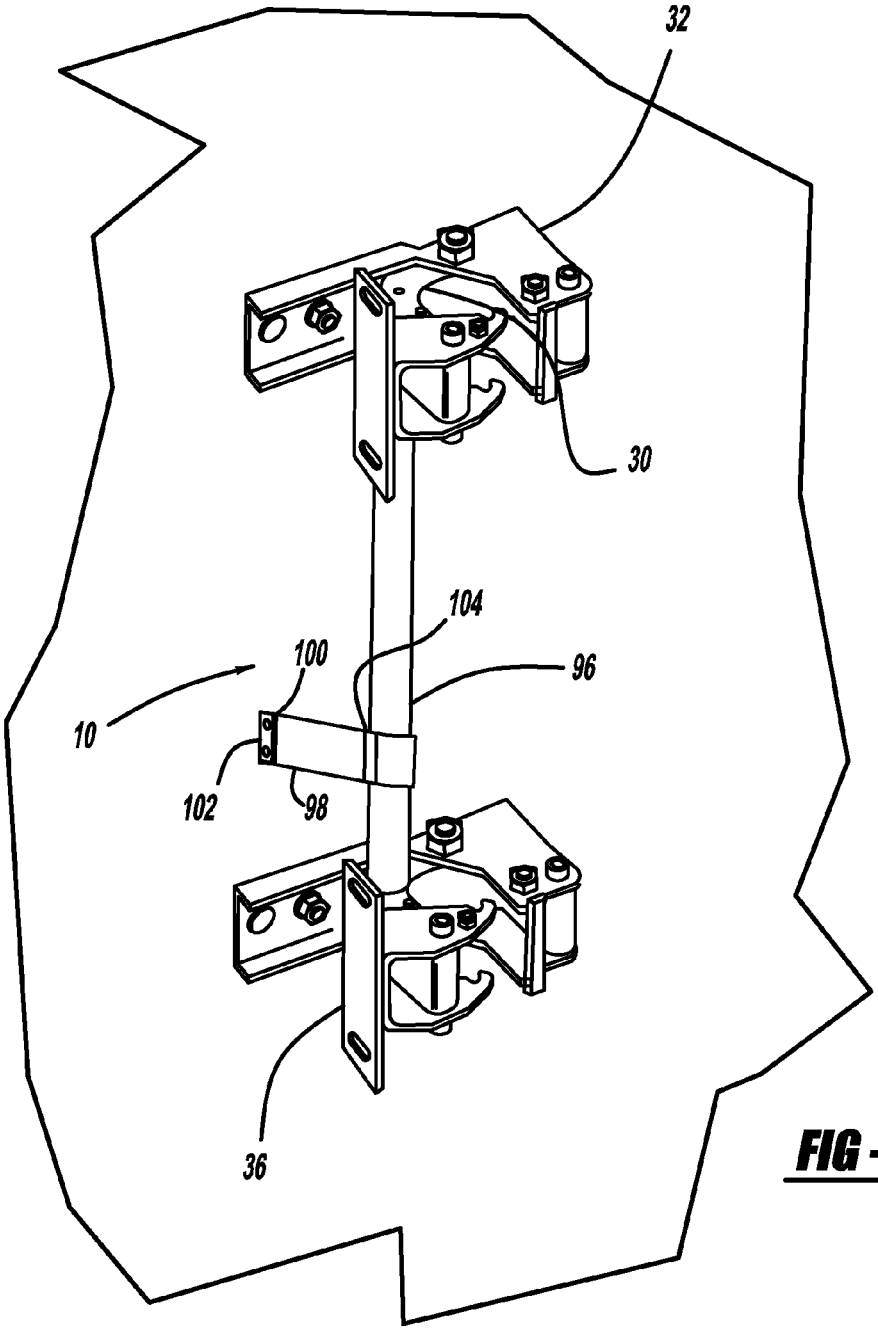
FIGS. 10A-10C are isometric views of a vehicle including the rear door articulating mechanism of FIG. 1, respectively illustrating the rear vehicle door in closed, and midway (approximately 90°) and fully (approximately 180°) opened positions, with the noted positions governed by the detent locations on the door hinge mount of FIG. 6A and the C-pillar hinge mount of FIG. 8A, and related door checks.

Referring to FIGS. 1-3 and 6A, door hinge mount 36 may further include recess 48 for engagement with stop 50 provided on hinge arm 30, with recess 48 being engageable with stop 50 in the rear door fully closed position of FIGS. 9A and 10A. A door check 52 in the form of a curved finger may be provided on door hinge mount 36 and engageable with stop 50 in the rear door midway open position of FIGS. 9B and 10B at which door 16 is disposed at approximately 90° relative to vehicle center line A-B or its initial closed position, and continually engageable with stop 50 as door 16 is moved from the midway open position of FIGS. 9B and 10B to the fully open position of FIGS. 9C and 10C at which door 16 is disposed at approximately 180° relative to its initial closed position.

Figure 8A:
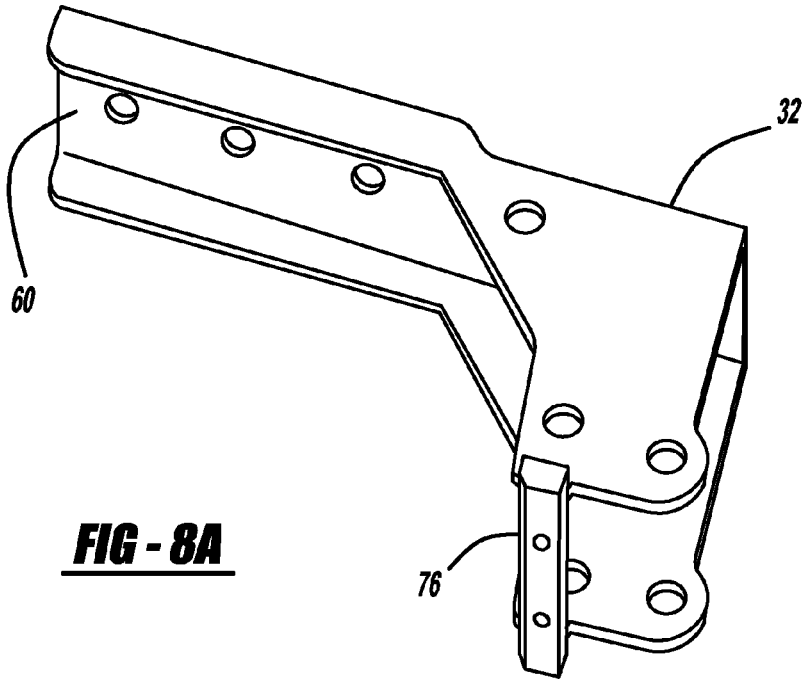
FIG. 8A is an enlarged isometric view of a C-pillar hinge mount for attachment of the rear door articulating mechanism of FIG. 1 to a vehicle C-pillar.
Figure 8B:
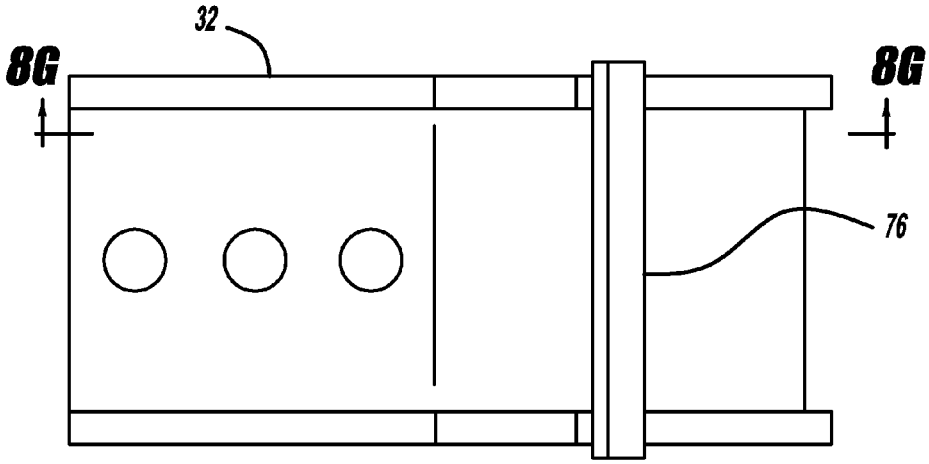
FIGS. 8B-8F are respectively enlarged front, top, bottom, right and left side views of the C-pillar hinge mount of FIG. 8A.
Figure 8C:
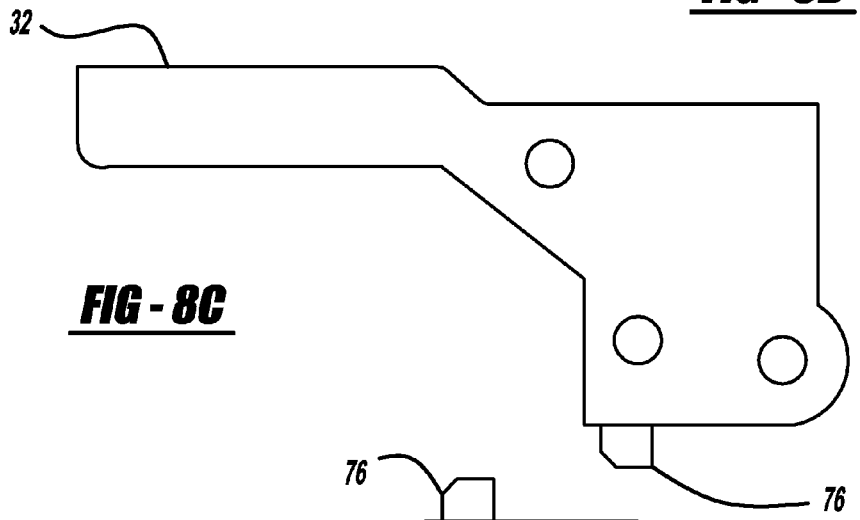
Figure 8D:
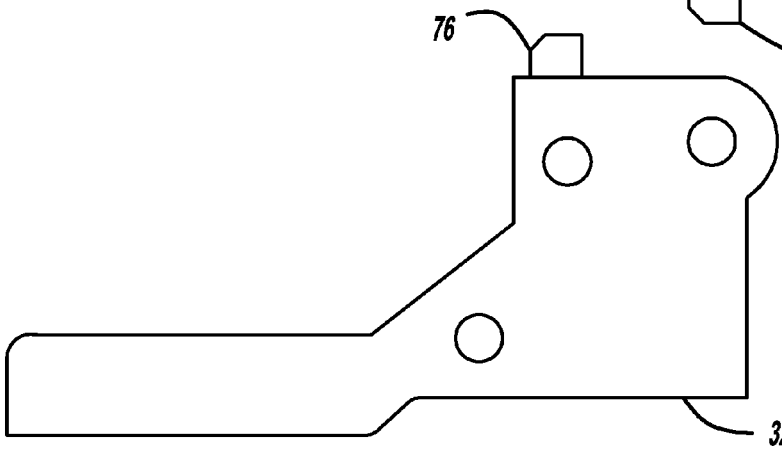
Figure 8E:
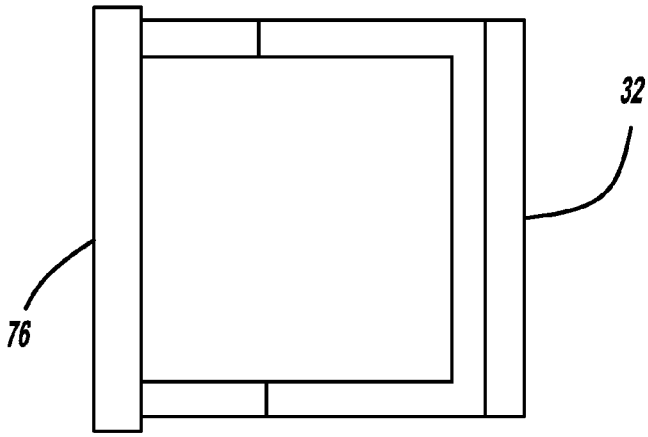
Figure 8F:
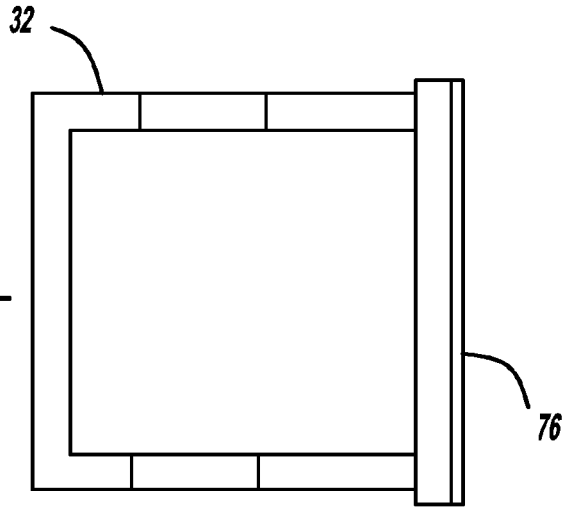
Figure 8G:
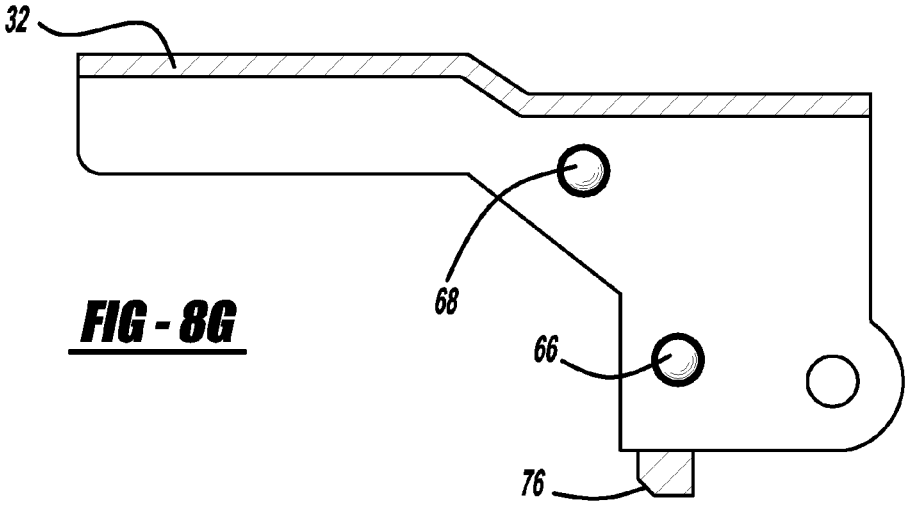
FIG. 8G is an enlarged cross-sectional view of the C-pillar hinge mount of FIG. 8A, taken generally along line 8G-8G in FIG. 8B, illustrating second and third detent locations for controlling predetermined opening/closing of a rear door.

Referring to FIGS. 1-3 and 8A, C-pillar hinge mount 32 may include a C-pillar mount bracket 60 for attachment of C-pillar hinge mount 32 to C-pillar 22 by means of screws, bolts, or by other means such as welding and the like. As shown in FIGS. 3 and 8G, C-pillar hinge mount 32 may further include spring loaded ball detents 62, 64, hereinafter denoted second and third detents 62, 64, for controlling predetermined opening/closing of rear door 16, by engagement of ball members 66, 68 in concave recesses 70, 72 provided on hinge arm 30. C-pillar hinge mount 32 may also include pivot pin 74 for pivotal connection at end 28 of hinge arm 30.

Figure 10B:
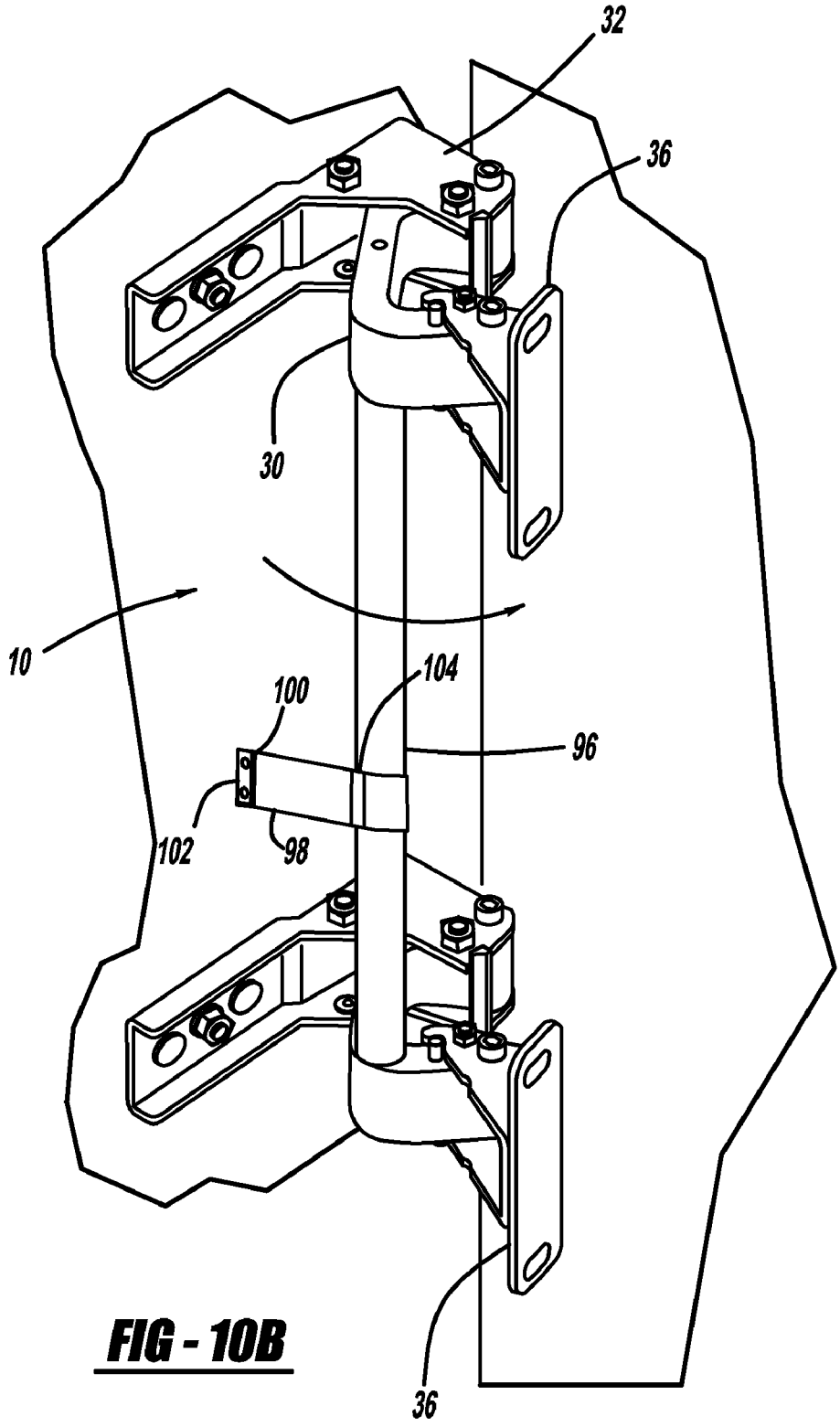
Figure 10C:
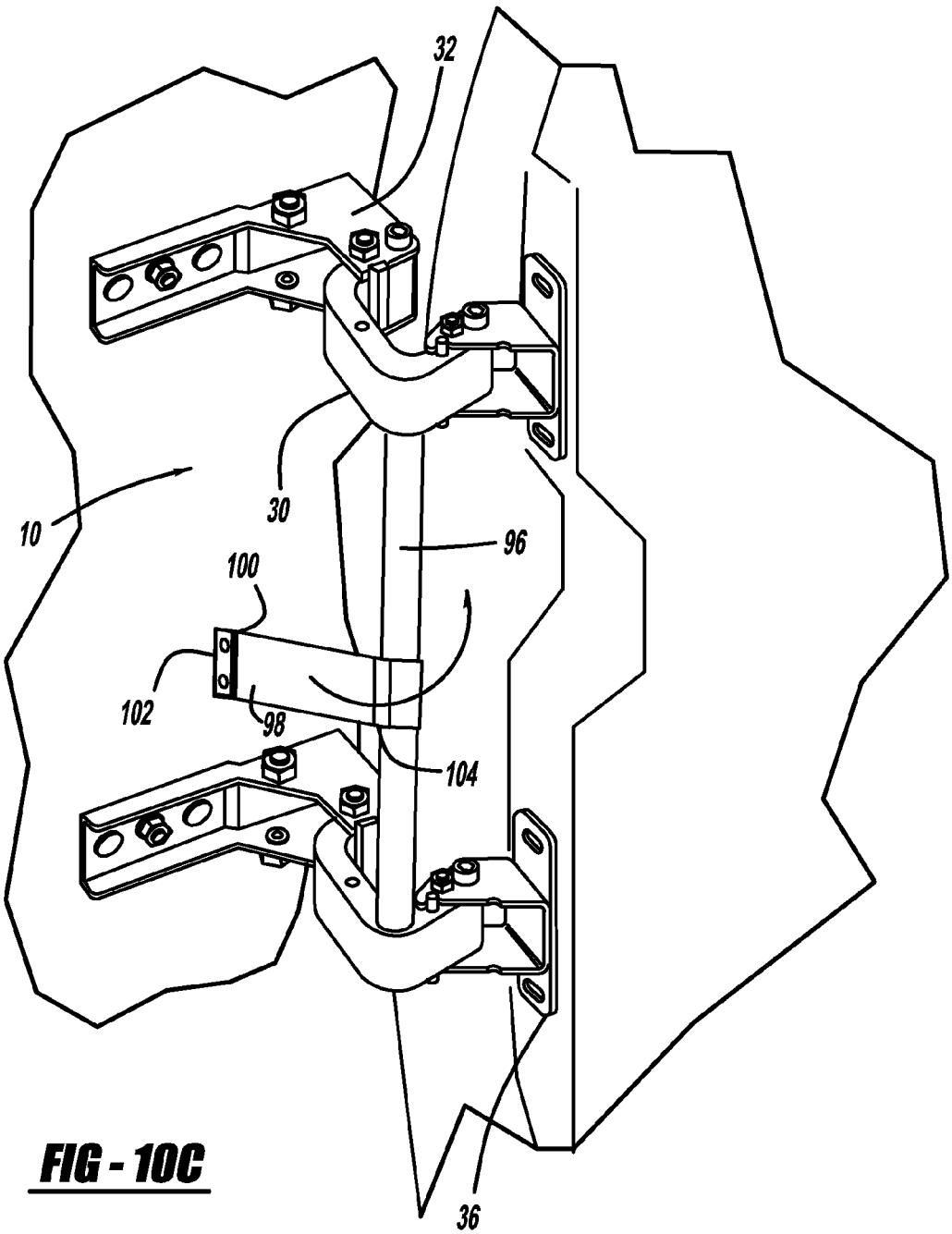

Referring to FIGS. 1-3 and 8A, C-pillar hinge mount 32 may further include door check 76 engageable with stop surface 78 of hinge arm 30 in the rear door fully open position of FIGS. 9C and 10C at which door 16 is disposed at approximately 180° relative to its initial closed position. In this position, the engagement of door check 76 and stop surface 78 prevent further rotation of rear door 16 to thus prevent contact of door 16 with vehicle body 80.

Referring next to FIGS. 1-3 and 7A-7F, as briefly discussed above, hinge arm 30 may generally include a U-shaped profile including sections 90, 92 and 94. Yet further, in the exemplary embodiment illustrated, articulating hinge assembly 26 may include upper and lower hinge arms 30 with cooperating door and C-pillar hinge mounts 36, 32, with the upper and lower hinge arms 30 being interconnected by a tie-bar 96. Optionally, as illustrated in the rear door fully open position of FIGS. 9C and 10C, a tie-strap 98 may be mounted at end 100 thereof to C-pillar mount 102 and at end 104 thereof around tie-bar 96 to provide a secondary means of limiting the degree of opening of rear door 16 in the event of door check 76 failure, or alternatively, to provide a means of limiting the degree of opening of rear door 16 if assembly 26 is required to be used with a vehicle including flared rear quarter panels (not shown) without requiring significant modification to C-pillar hinge mount 32.

The opening/closing of rear door 16 will now be described in detail with reference to FIGS. 1-12B (especially FIGS. 9A-12B).

Referring to FIGS. 9A-9C, these figures illustrate top views of vehicle 12 including rear door articulating mechanism 26 with rear vehicle door 16 disposed in closed, and midway (approximately 90°) and fully (approximately 180°) opened positions (note FIGS. 10A-10C illustrate the views of FIGS. 9A-9C in isometric). Referring to FIG. 9A, in the door 16 closed position, ball member 68 of third detent 64 may be engaged with concave recess 72 of hinge arm 30, and recess 48 of door hinge mount 36 may be engaged with stop 50 of hinge arm 30. Referring to FIG. 9B, as door 16 is rotated from the closed position of FIG. 9A, hinge arm 30 may remain in the position of FIG. 9A due to the resistance provided by engagement of ball member 68 of third detent 64 engaged with concave recess 72 of hinge arm 30. When door 16 is rotated approximately 90° relative to the vehicle center line A-B or its initial closed position, door check 52 on door hinge mount 36 engages with stop 50 of hinge arm 30. At this stage, door 16 is maintained at the approximately 90° orientation due to the engagement of ball member 42 of first detent 40 within concave recess 44 of hinge arm 30. As is readily evident to those skilled in the art, at the FIG. 9B approximately 90° orientation, door 16 may be articulated further to the approximately 180° orientation of FIG. 9C or rotated back to the closed configuration of FIG. 9A by a user overcoming the resistance provided by the engagement of ball member 42 of first detent 40 within concave recess 44 of hinge arm 30.

Referring to FIG. 9C, as door 16 is now articulated from the approximately 90° orientation of FIG. 9B to the fully open (i.e. approximately 180°) position of FIG. 9C, the engagement of door check 52 with stop 50 overcomes the engagement resistance of ball member 68 of third detent 64 from concave recess 72 of hinge arm 30 to thus allow further articulation of hinge arm 30, and articulation of door 16 to the approximately 180° orientation of FIG. 9C. Once door 16 reaches the approximately 180° orientation of FIG. 9C, ball member 66 of second detent 62 is disposed in concave recess 70 of hinge arm 30 to maintain door 16 in the approximately 180° orientation of FIG. 9C. At the same time, door check 76 engages with stop surface 78 of hinge arm 30 to prevent rotation/articulation of door 16 beyond the approximately 180° orientation of FIG. 9C, and thus contact with vehicle body 80. Further, if articulating hinge assembly 26 optionally includes tie-strap 98, as briefly discussed above, the engagement of tie-strap 98 with C-pillar mount 102 and tie-bar 96 further prevents rotation/articulation of door 16 beyond the approximately 180° orientation of FIG. 9C.

In order to close door 16, as is readily evident and as briefly discussed above, door 16 may be rotated or articulated from the approximately 180° orientation of FIG. 9C to the approximately 90° orientation of FIG. 9B to the closed position of FIG. 9A, in one single step or in partial steps between the aforementioned intermediate locations, with the aforementioned detents and stops disengaging in a reverse sequence.

Figure 11A:
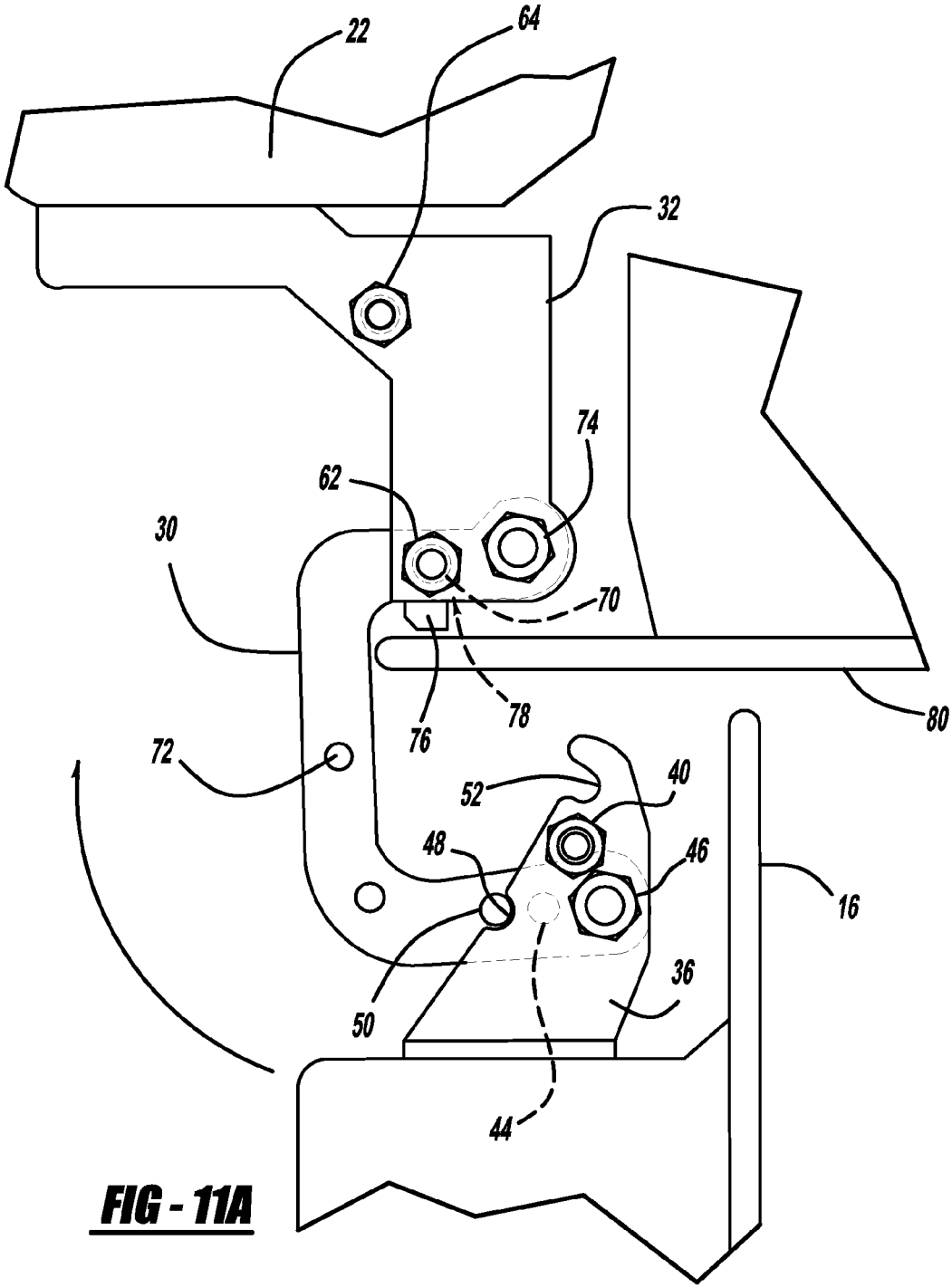
FIGS. 11A and 11B are top views of a vehicle including the rear door articulating mechanism of FIG. 1, respectively illustrating the rear vehicle door in first and second alternate closing positions.
Figure 11B:
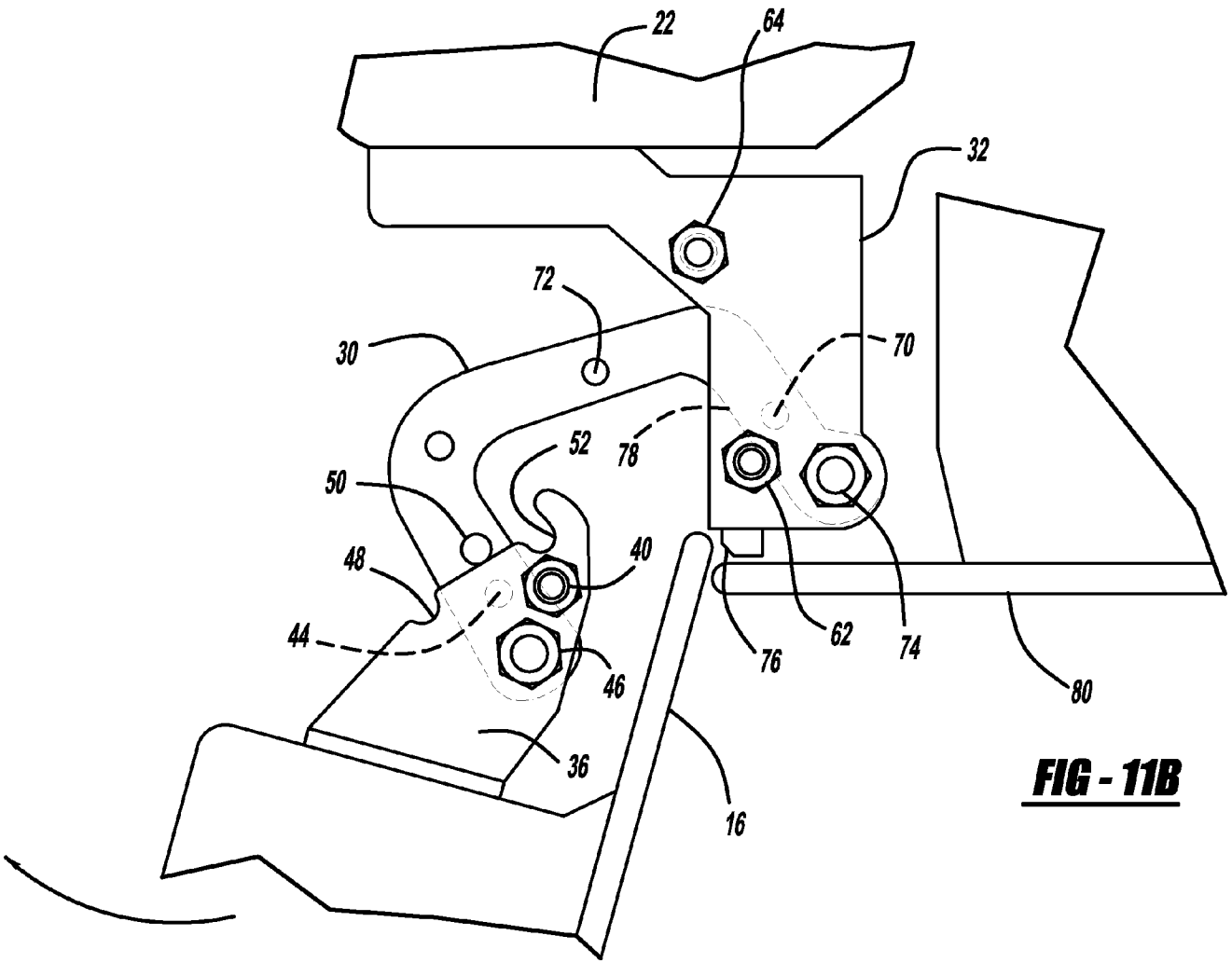
Figure 12A:
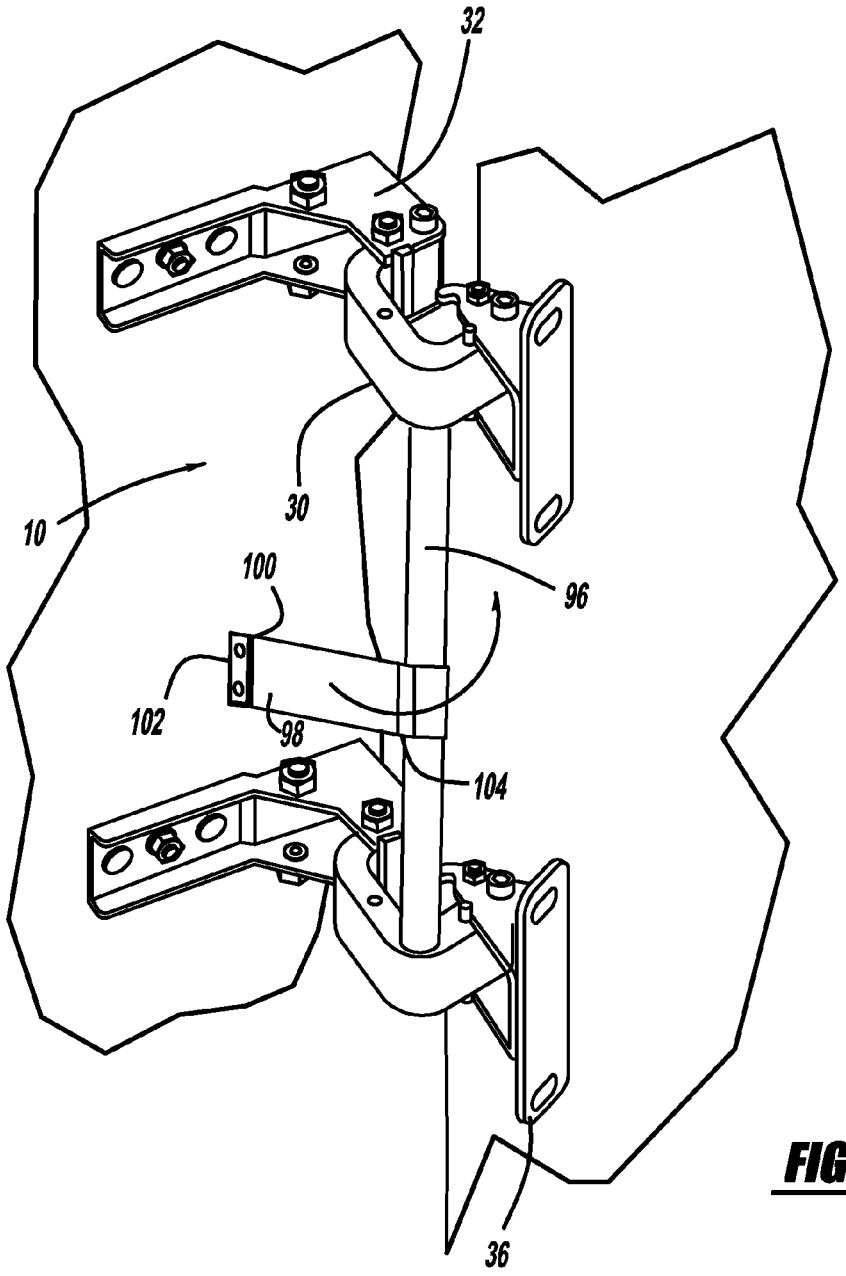
FIGS. 12A and 12B are isometric views of a vehicle including the rear door articulating mechanism of FIG. 1, respectively illustrating the rear vehicle door in first and second alternate closing positions.
Figure 12B:
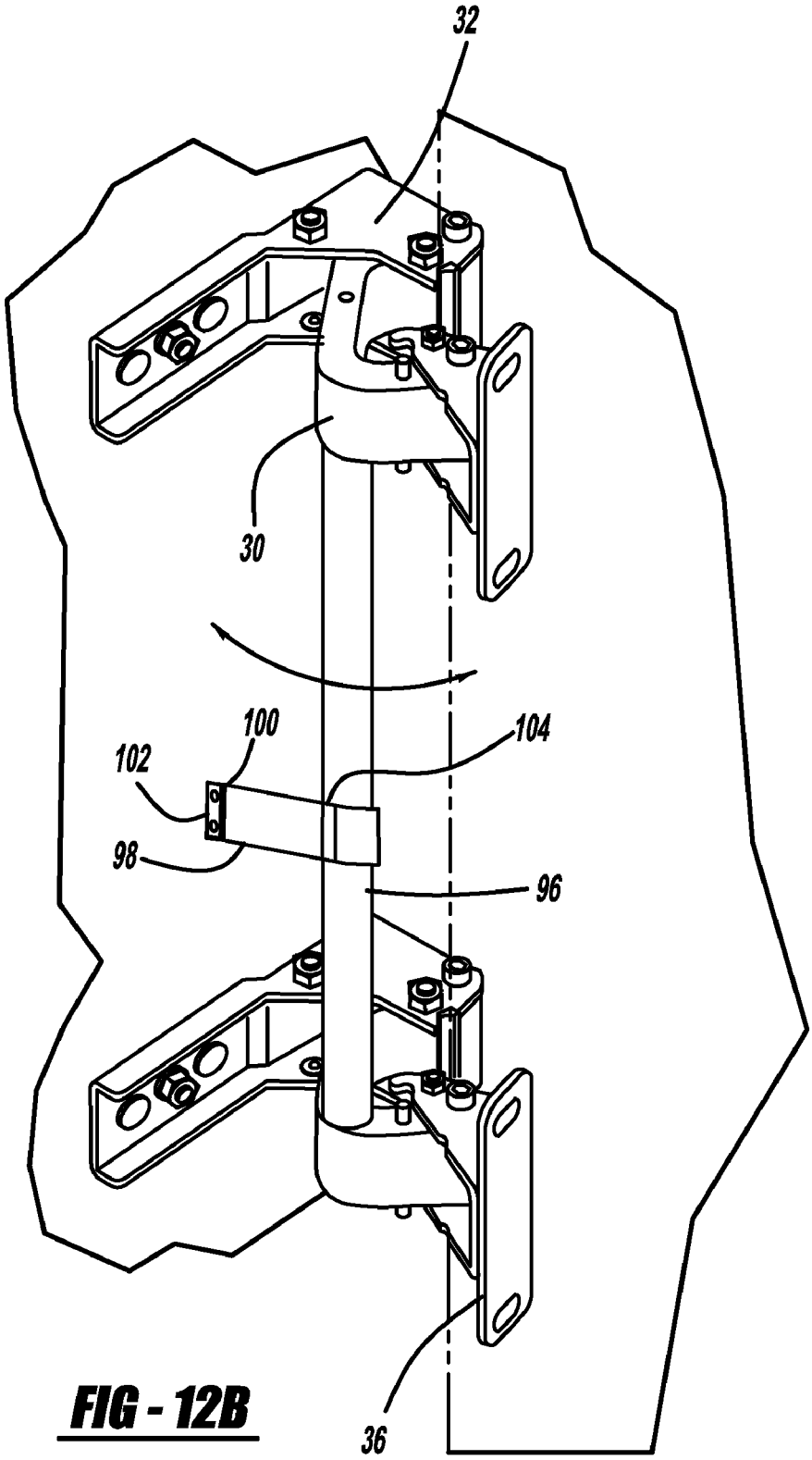

However, as discussed above, since the present invention articulating hinge assembly 26 requires no particular opening or closing sequence for door 16, referring to FIGS. 11A and 11B, the rear door first and second alternate closing positions are illustrated (note FIGS. 12A and 12B illustrate the views of FIGS. 11A and 11B in isometric). As shown in the first alternate closing position of FIG. 11A, as door 16 is rotated from the fully open approximately 180° orientation of FIG. 9C towards its midway open approximately 90° orientation, ball member 66 of second detent 62 may remain engaged with concave recess 70 of hinge arm 30, and ball member 42 of first detent 40 may disengage from concave recess 44 of hinge arm 30. Simultaneously, door check 52 on door hinge mount 36 may disengage from stop 50 of hinge arm 30 to thus allow door 16 to rotate to the first alternate approximately 90° closing orientation of FIG. 11A.

From the first alternate approximately 90° closing orientation of FIG. 11A to the second alternate approximately 45° closing orientation of FIG. 11B (note the 45° orientation is only exemplary for the orientation of FIG. 11B, and can vary as readily evident to those skilled in the art), ball member 66 of second detent 62 may disengage from concave recess 70 of hinge arm 30 to thus allow articulation of hinge arm 30 in the rear door closing direction as shown in FIG. 11B.

As readily evident in view of the disclosure, door 16 may be rotated from the FIG. 11B to the FIG. 9A door closed position by simply continuing rotation of door 16 in the door closing direction to re-engage ball member 68 of third detent 64 with concave recess 72 of hinge arm 30, and recess 48 of door hinge mount 36 with stop 50 of hinge arm 30.

To summarize, the invention thus provides rear door articulating mechanism 10 for vehicle rear door articulation, with the system permitting opening and closing of a rear door at up to approximately 180° relative to the door initial closed position. The system requires minimal modification of a vehicle structure, in that, components such as hinge arm 30, and door and C-pillar hinge mounts 36, 32 can be installed by minimal modification to a C-pillar area or the rear door structure. The invention facilitates ease of ingress and egress and allows maximum access for loading and unloading of transportable items. Based on the discussion above, the mode of opening of rear door 16 is not constrained by parking lot restrictions that limit conventional door opening when adjacent to another vehicle or object that prevents full rotation of a conventional hinged door. Thus, parking lot entrapment, which prevents access to the door openings in such situations, is thereby avoided.

Those skilled in the art would readily appreciate in view of this disclosure that various modifications could be made to the aforementioned components, without departing from the scope of the present invention. For example, as discussed above, whereas mechanism 10 has been described and illustrated as including an articulating hinge assembly 26 including parallel disposed upper and lower hinge arms 30 (see FIGS. 1-3), additional or fewer hinge components (i.e. one or more pairs of hinge arms and related components) may be provided based on the stability and size of the rear door and related components. Further, whereas hinge arms 30 have been illustrated as including a generally U-shaped profile for facilitating predetermined articulation of rear door 16, the curvature of arm 30 may be varied as needed for controlling movement of door 16. Moreover, whereas door 16 has been discussed as being manually operable via a door handle, mechanism 10 may be used with an automatic door 16 operable, for example, by a remote or vehicle mounted push-button. Yet farther, whereas mechanism 10 has been described as being usable with rear door 16 in the exemplary embodiment illustrated, it is readily evident that mechanism 10 may be usable with a vehicle front, middle or other doors, or with a compartment closure (i.e. broadly a vehicle door for the occupant compartment or another compartment for storing objects), or a tailgate assembly, for facilitating the afore-described articulating/sliding operation. Yet further, whereas the aforementioned detents 40, 62, 64 or stop 50 or door check 76 have been discussed and illustrated as providing predetermined stoppage of door 16 at approximately 0°, 90° or 180°, the locations and/or number of the detents, stops or door checks may be changed as needed for changing the stoppage locations of door 16.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A vehicle rear door articulating mechanism comprising:

at least one articulating hinge assembly including:

at least one hinge arm pivotally mounted to a vehicle C-pillar at one end thereof via a C-pillar hinge mount and pivotally mounted to a vehicle rear door at another end thereof via a door hinge mount, said hinge arm including a generally U-shaped profile between said ends thereof for permitting articulation of the rear door up to 180° from a rear door closed position, said door hinge mount including a door check that engages with a stop on said hinge arm, for limiting pivotal movement of the vehicle rear door to a first intermediate open position from the rear door closed position, upon pivotal movement of said door check relative to said hinge arm, wherein one of said hinge arm and said door hinge mount include at least one first recess that engages with a first detent on the other one of said hinge arm and said door hinge mount for maintaining the rear door in the first intermediate open position.

2. A vehicle rear door articulating mechanism according to claim 1, wherein one of said hinge arm and said C-pillar hinge mount include at least one second recess engageable with a second detent on the other one of said hinge arm and said C-pillar hinge mount for maintaining the rear door in a rear door fully open position.

3. A vehicle rear door articulating mechanism according to claim 2, wherein one of said hinge arm and said C-pillar hinge mount include at least one third recess engageable with a third detent on the other one of said hinge arm and said C-pillar hinge mount for maintaining the rear door in the rear door closed position.

4. A vehicle rear door articulating mechanism according to claim 3, wherein in the rear door fully open position, said second recess and detent being engageable to prevent pivotal movement of said hinge arm, and said first recess and detent being disengageable to allow pivotal movement of the rear door to a second intermediate open position, generally parallel to the first intermediate open position.

5. A vehicle rear door articulating mechanism according to claim 4, wherein said door hinge mount including a fourth recess engageable with said stop to maintain the rear door in the second intermediate open position.

6. A vehicle rear door articulating mechanism according to claim 3, wherein in the rear door fully open position, said first and second recess and detent being disengageable to allow pivotal movement of the rear door to a second intermediate open position.

7. A vehicle rear door articulating mechanism according to claim 1, further comprising a tie-bar connected to an upper and lower hinge arm of the at least one hinge arm for thereby providing rigidity for simultaneous operation of upper and lower hinge assemblies of the at least one hinge assembly.

8. A vehicle door articulating mechanism comprising:

at least one articulating hinge assembly including:

at least one hinge arm pivotally mounted to a vehicle body structure at one end thereof via a body structure hinge mount and pivotally mounted to a vehicle door at another end thereof via a door hinge mount, said hinge arm including a generally curved profile between said ends thereof for permitting articulation of the door up to a predetermined angle from a door closed position, said door hinge mount including a door check that engages with a stop on said hinge arm, for limiting pivotal movement of the vehicle door to a first intermediate open position from the door closed position, upon pivotal movement of said door check relative to said hinge arm, wherein one of said hinge arm and said door hinge mount include at least one first recess that engages with a first detent on the other one of said hinge arm and said door hinge mount for maintaining the door in the first intermediate open position.

9. A vehicle door articulating mechanism according to claim 8, wherein one of said hinge arm and said body structure hinge mount include at least one second recess engageable with a second detent on the other one of said hinge arm and said body structure hinge mount for maintaining the door in a door fully open position.

10. A vehicle door articulating mechanism according to claim 9, wherein one of said hinge arm and said body structure hinge mount include at least one third recess engageable with a third detent on the other one of said hinge arm and said body structure hinge mount for maintaining the door in the door closed position.

11. A vehicle door articulating mechanism according to claim 10, wherein in the door fully open position, said second recess and detent being engageable to prevent pivotal movement of said hinge arm, and said first recess and detent being disengageable to allow pivotal movement of the door to a second intermediate open position, generally parallel to the first intermediate open position.

12. A vehicle door articulating mechanism according to claim 11, wherein said door hinge mount including a fourth recess engageable with said stop to maintain the door in the second intermediate open position.

13. A vehicle door articulating mechanism according to claim 10, wherein in the door fully open position, said first and second recess and detent being disengageable to allow pivotal movement of the door to a second intermediate open position.

14. A vehicle door articulating mechanism according to claim 8, further comprising a tie-bar connected to an upper and lower hinge arm of the at least one hinge arm for thereby providing rigidity for simultaneous operation of upper and lower hinge assemblies of the at least one hinge assembly.

15. A vehicle compartment closure articulating mechanism comprising:

at least one articulating hinge assembly including:

at least one hinge arm pivotally mounted to a vehicle body structure at one end thereof via a body structure hinge mount and pivotally mounted to a vehicle compartment closure at another end thereof via a compartment closure hinge mount, said hinge arm including a generally curved profile between said ends thereof for permitting articulation of the compartment closure up to a predetermined angle from a compartment closure closed position, said compartment closure hinge mount including a compartment closure check that engages with a stop on said hinge arm, for limiting pivotal movement of the vehicle compartment closure to a first intermediate open position from the compartment closure closed position, upon pivotal movement of said compartment closure check relative to said hinge arm, wherein one of said hinge arm and said compartment closure hinge mount include at least one first recess that engages with a first detent on the other one of said hinge arm and said compartment closure hinge mount for maintaining the compartment closure in the first intermediate open position.

16. A vehicle compartment closure articulating mechanism according to claim 15, wherein one of said hinge arm and said body structure hinge mount include at least one second recess engageable with a second detent on the other one of said hinge arm and said body structure hinge mount for maintaining the compartment closure in a compartment closure fully open position.

17. A vehicle compartment closure articulating mechanism according to claim 16, wherein one of said hinge arm and said body structure hinge mount include at least one third recess engageable with a third detent on the other one of said hinge arm and said body structure hinge mount for maintaining the compartment closure in the compartment closure closed position.

18. A vehicle compartment closure articulating mechanism according to claim 17, wherein in the compartment closure fully open position, said second recess and detent being engageable to prevent pivotal movement of said hinge arm, and said first recess and detent being disengageable to allow pivotal movement of the compartment closure to a second intermediate open position, generally parallel to the first intermediate open position.

19. A vehicle compartment closure articulating mechanism according to claim 18, wherein said compartment closure hinge mount including a fourth recess engageable with said stop to maintain the compartment closure in the second intermediate open position.

20. A vehicle compartment closure articulating mechanism according to claim 17, wherein in the compartment closure fully open position, said first and second recess and detent being disengageable to allow pivotal movement of the compartment closure to a second intermediate open position.

21. A vehicle compartment closure articulating mechanism according to claim 15, further comprising a tie-bar connected to an upper and lower hinge arm of the at least one hinge arm for thereby providing rigidity for simultaneous operation of upper and lower hinge assemblies of the at least one hinge assembly.

22. A vehicle door articulating hinge assembly comprising a hinge arm pivotally mounted to a vehicle via a body hinge mount and pivotally mounted to a vehicle door via a door hinge mount said hinge arm comprising a generally curved profile between ends thereof permitting articulation of the door , said door hinge mount comprising a door check that engages with a stop on said hinge arm for limiting pivotal movement of the door to an open intermediate position, wherein one of said hinge arm and said door hinge mount include at least one first recess that engages with a first detent on the other one of said hinge arm and said door hinge mount for maintaining the rear door in the open intermediate position.

* * * * *